US009032575B2

(12) United States Patent
Sebor et al.

(10) Patent No.: US 9,032,575 B2
(45) Date of Patent: May 19, 2015

(54) TURBINE-DRIVEN SWIMMING POOL CLEANING APPARATUS AND METHOD

(71) Applicant: Pavel Sebor, Heathrow, FL (US)

(72) Inventors: Pavel Sebor, Heathrow, FL (US); Robert Sebor, Sanford, FL (US)

( * ) Notice: Subject to any disclaimer, the term of this patent is extended or adjusted under 35 U.S.C. 154(b) by 0 days.

(21) Appl. No.: 14/017,758

(22) Filed: Sep. 4, 2013

(65) Prior Publication Data

US 2014/0115796 A1 May 1, 2014

Related U.S. Application Data

(60) Provisional application No. 61/720,208, filed on Oct. 30, 2012.

(51) Int. Cl.
*E04H 4/16* (2006.01)

(52) U.S. Cl.
CPC ..... *E04H 4/1654* (2013.01)

(58) Field of Classification Search
CPC ..... E04H 4/16; E04H 4/1654; E04H 4/1672
USPC ..... 15/1.7
See application file for complete search history.

(56) References Cited

U.S. PATENT DOCUMENTS

| | | | | |
|---|---|---|---|---|
| 2,556,022 | A | 6/1951 | Amen | |
| 2,641,015 | A | 6/1953 | Lovick | |
| 2,846,711 | A | 8/1958 | Brace | |
| 3,019,462 | A | 2/1962 | Nash et al. | |
| 3,950,809 | A | 4/1976 | Schatzmann | |
| 3,959,838 | A | 6/1976 | Hannah | |
| 3,960,809 | A | 6/1976 | Ramey et al. | |
| 4,304,022 | A | 12/1981 | Sommer | |
| 4,536,908 | A | 8/1985 | Raubenheimer | |
| 4,589,986 | A | 5/1986 | Greskovics et al. | |
| 4,656,683 | A | 4/1987 | Raubenheimer | |
| 4,683,599 | A | 8/1987 | Rief | |
| 4,722,110 | A | 2/1988 | Chandler | |
| 4,817,991 | A | 4/1989 | Frentzel et al. | |
| D304,505 | S | 11/1989 | Maier et al. | |
| 4,920,599 | A | 5/1990 | Rief | |
| 5,097,559 | A * | 3/1992 | Brunt et al. | 15/1.7 |
| 5,099,535 | A | 3/1992 | Chauvier et al. | |
| 5,172,445 | A | 12/1992 | Chandler | |
| 5,197,158 | A | 3/1993 | Moini | |
| 5,293,659 | A | 3/1994 | Rief et al. | |

(Continued)

FOREIGN PATENT DOCUMENTS

FR 2584442 * 1/1987

*Primary Examiner* — Mark Spisich
(74) *Attorney, Agent, or Firm* — Carl M. Napolitano; GrayRobinson, P.A.

(57) ABSTRACT

A swimming pool cleaner is driven along a submerged surface by water and debris flowing past a turbine positioned between an inlet and outlet of the cleaner. Rollers are rotatably carried on the bottom of the cleaner and forward and aft the proximate an inlet port. The rollers in combination with lower side wall portions of the housing form a plenum for water and enhance adherence of the pool cleaner to the submerged pool surface being cleaner. A hose connector operable with an outlet port is angled toward the forward direction of movement of the pool cleaner such that a suction hose will be placed slightly ahead of the pool cleaner when climbing a side wall surface to provide a weight for keeping the cleaner below the water surface and thus prevent an undesirable sucking of air at the inlet.

28 Claims, 19 Drawing Sheets

(56) References Cited

U.S. PATENT DOCUMENTS

| | | | |
|---|---|---|---|
| 5,337,434 | A | 8/1994 | Erlich |
| 5,351,355 | A | 10/1994 | Chiniara |
| 5,363,877 | A | 11/1994 | Frentzel et al. |
| 5,379,473 | A | 1/1995 | Rief et al. |
| 5,428,854 | A | 7/1995 | Rief et al. |
| 5,454,129 | A | 10/1995 | Kell |
| 5,469,596 | A | 11/1995 | Rief et al. |
| 5,554,277 | A | 9/1996 | Rief et al. |
| 5,557,822 | A | 9/1996 | Yagi et al. |
| D376,450 | S | 12/1996 | Campbell et al. |
| 5,604,950 | A | 2/1997 | Stern |
| 5,617,600 | A | 4/1997 | Frattini |
| 5,799,351 | A | 9/1998 | Rief et al. |
| D417,047 | S | 11/1999 | Tsuda |
| D418,640 | S | 1/2000 | Veloskey et al. |
| D421,512 | S | 3/2000 | Campbell |
| D429,393 | S | 8/2000 | Rief et al. |
| 6,115,864 | A | 9/2000 | Davidsson et al. |
| 6,131,227 | A | 10/2000 | Rief et al. |
| D433,545 | S | 11/2000 | Hollinger et al. |
| 6,155,657 | A | 12/2000 | Erlich et al. |
| 6,199,237 | B1 | 3/2001 | Budden |
| 6,212,725 | B1 | 4/2001 | Porat |
| 6,237,175 | B1 | 5/2001 | Phillipson et al. |
| D443,737 | S | 6/2001 | Rief et al. |
| D444,280 | S | 6/2001 | Rief et al. |
| D445,225 | S | 7/2001 | Schaub |
| 6,289,918 | B1 | 9/2001 | Rief et al. |
| 6,292,970 | B1 | 9/2001 | Rief et al. |
| 6,298,513 | B1 | 10/2001 | Rief et al. |
| D456,101 | S | 4/2002 | Lee |
| 6,460,564 | B1 | 10/2002 | Rief et al. |
| 6,473,927 | B1 | 11/2002 | Sommer |
| D469,589 | S | 1/2003 | Wichmann et al. |
| D471,330 | S | 3/2003 | Campbell |
| 6,560,808 | B2 | 5/2003 | Phillipson et al. |
| 6,564,417 | B2 | 5/2003 | Porat |
| 6,665,900 | B2 | 12/2003 | Wichmann et al. |
| 6,691,811 | B2 | 2/2004 | Bruentrup et al. |
| 6,706,175 | B1 | 3/2004 | Rief et al. |
| 6,733,046 | B1 | 5/2004 | Rief |
| 6,782,578 | B1 | 8/2004 | Rief et al. |
| 6,820,297 | B2 | 11/2004 | Phillipson et al. |
| 6,854,148 | B1 | 2/2005 | Rief et al. |
| 6,886,205 | B1 | 5/2005 | Pichon |
| 6,942,790 | B1 | 9/2005 | Dolton |
| 6,954,960 | B2 | 10/2005 | Pichon |
| D521,696 | S | 5/2006 | Choi |
| 7,117,554 | B2 | 10/2006 | Pichon |
| 7,118,632 | B2 | 10/2006 | Sumonthee |
| 7,293,314 | B2 | 11/2007 | Henkin et al. |
| D575,915 | S | 8/2008 | Dreyer |
| 7,464,429 | B2 | 12/2008 | Stoltz |
| 7,506,770 | B2 | 3/2009 | Rief |
| 7,520,282 | B2 | 4/2009 | Stoltz |
| D599,967 | S | 9/2009 | Blanc-Tailleur |
| 7,805,792 | B2 * | 10/2010 | Roumagnac ..... 15/1.7 |
| 7,849,547 | B2 | 12/2010 | Erlich et al. |
| 7,908,697 | B2 | 3/2011 | Lavabre et al. |
| 7,945,981 | B2 | 5/2011 | Lapping |
| D670,462 | S | 11/2012 | Mastio et al. |
| 8,307,485 | B2 | 11/2012 | Sumonthee |
| 8,341,789 | B2 | 1/2013 | Garti |
| 8,402,585 | B2 | 3/2013 | Rief et al. |
| 8,402,586 | B2 | 3/2013 | Lavabre |
| 8,424,142 | B2 | 4/2013 | Garti |
| 8,474,081 | B2 | 7/2013 | Stoltz |
| 8,561,240 | B2 | 10/2013 | Hui |
| 2003/0224889 | A1 | 12/2003 | Luh |
| 2004/0074024 | A1 | 4/2004 | Bavoso |
| 2006/0143841 | A1 | 7/2006 | Niewiarowski |
| 2008/0092322 | A1 | 4/2008 | Halle et al. |
| 2008/0222821 | A1 | 9/2008 | Pichon |
| 2008/0244842 | A1 | 10/2008 | Lavabre et al. |
| 2009/0229061 | A1 | 9/2009 | Stoltz et al. |
| 2009/0300862 | A1 | 12/2009 | Schneider et al. |
| 2010/0299863 | A1 | 12/2010 | Dewing |
| 2011/0088181 | A1 | 4/2011 | Rief et al. |
| 2011/0154585 | A1 | 6/2011 | Mastio et al. |
| 2011/0154586 | A1 | 6/2011 | Mastio et al. |
| 2011/0314617 | A1 | 12/2011 | Van Der Meijden et al. |
| 2012/0060307 | A1 | 3/2012 | Stoltz |
| 2012/0144605 | A1 | 6/2012 | Dewings |
| 2012/0210527 | A1 | 8/2012 | Erlich et al. |
| 2013/0031729 | A1 | 2/2013 | Bernini |
| 2013/0031734 | A1 | 2/2013 | Porat et al. |
| 2013/0152316 | A1 | 6/2013 | Rief et al. |

* cited by examiner

TURBINE-DRIVEN SWIMMING POOL CLEANING APPARATUS AND METHOD

CROSS REFERENCE TO RELATED APPLICATION

This application claims priority to U.S. Provisional Patent Application No. 61/720,208 filed on Oct. 30, 2012 for Turbine-Driven Swimming Pool Cleaning Apparatus and Method, the disclosure of which is hereby incorporated by reference herein in its entirety, and commonly owned.

FIELD OF INVENTION

The present invention generally relates to swimming pool cleaners, and more particularly to an automatic pool cleaner driven by a flow of water through a turbine engine for providing movement along and cleaning of submerged surfaces of a swimming pool.

BACKGROUND

Submersible pool cleaners having driving mechanisms carried within a housing that engages the submerged surface of the pool are generally well known, such as the three or four wheeled swimming pool pressure cleaner with internal steering mechanism described in U.S. Pat. Nos. 6,782,578 and 6,854,148 to Rief et al., the disclosures of which are herein incorporated by reference in their entirety. Various pool cleaners are turbine driven as in the aforementioned patents including a turbine motor as described in U.S. Pat. No. 6,292,970, the disclosure of which are herein incorporated by reference in their entirety. Further, also generally known are the problems associated with debris clogging fluid flow passages, wearing cleaner components rendering the cleaner ineffective or unusable, and the difficulty for a consumer attempting to replace such worn components.

As is well known, and as emphasized in U.S. Pat. No. 6,131,227 to Rief et al, the disclosure of which are herein incorporated by reference in their entirety, the proper functioning of swimming pool cleaners typically rely on a skirt bordering and extending downwardly from the body of the pool cleaner. The skirt generally maintains an effective fluid suction within a plenum of water proximate the inlet to the cleaner, generally dislodges loose debris, accommodates uneven surfaces, provides a fluid suction force to keep the pool cleaner pressed against the submerged surface and yet allow the pool cleaner to travel up and across submerged steeply inclined and vertical surfaces.

There remains a need to improve upon performance of the submersible pool cleaner such that the pool cleaner can effectively and efficiently automatically navigate over obstacles such as bottom drains and larger debris, and be able to upright itself in the event it should fall on its back. Yet further, when debris flows through the turbine, it is desirable to have the debris work its way through the cleaner while maintaining maximum power without compromising function, and without having to stop automatic operation and access the housing to clean the debris. Those experienced with submersible pool cleaners appreciate that it is desirable to keep the cleaner below the water surface to prevent it from sucking air as it climbs vertical walls of the pool.

Embodiments of the present invention herein described provide an efficiently run submersible cleaner which includes components that are easily replaceable by the consumer and operate to meet such needs.

SUMMARY

A swimming pool cleaner according to the teachings of the present invention may comprise a turbine motor driven by a flow of water for operation of the pool cleaner along a submerged surface to be cleaned. The turbine comprises a turbine housing having a rotor rotatably mounted in a chamber to provide a flow path for water and debris around the rotor. Turbine vanes may be rigidly attached about and extend from a periphery of the turbine rotor. A valve element may be located proximate the vanes and inlet port such that the valve element is movable with respect to distal ends of the turbine vanes to allow passage of debris of substantial size through the turbine. The pool cleaner may include a roller positioned on a bottom forward portion thereof proximate the inlet port and a retractable element, such as an elongate flap or second roller, pivotably carried by the pool cleaner and positioned on a bottom rearward portion proximate the inlet port. The roller and retractable element, in combination with side wall portions of the housing of the cleaner, form a plenum of water enhancing adherence of the pool cleaner to the pool surface.

A hose connector operable with an outlet port is angled toward the forward direction of movement of the pool cleaner such that a hose connected to the hose connector will be placed slightly ahead of the pool cleaner when climbing a side wall surface. A water filled hose provides weight for keeping the cleaner below the water surface and thus prevents a sucking of air at an inlet port.

BRIEF DESCRIPTION OF THE DRAWINGS

For a fuller understanding of the invention, reference is made to the following detailed description, taken in connection with the accompanying drawings illustrating various embodiments of the present invention, in which.

DETAILED DESCRIPTION OF EMBODIMENTS

Figure 1:
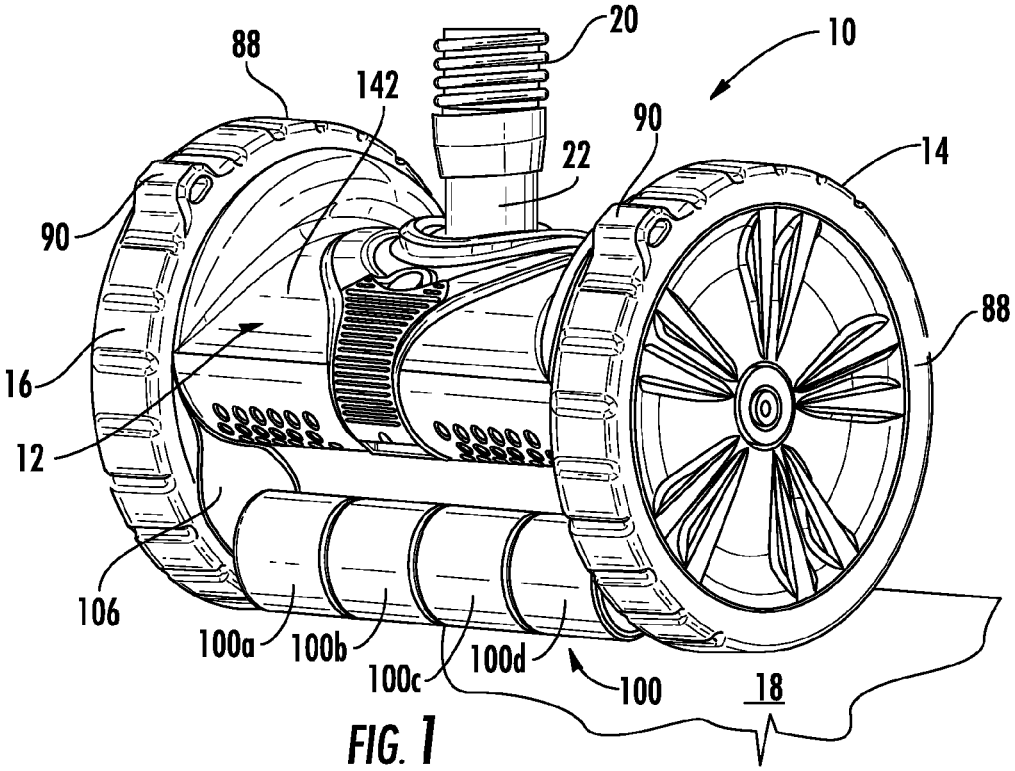
FIG. 1 is a top, front right perspective view of one embodiment of a submersible swimming pool cleaner according to the teachings of the present invention.
Figure 2:
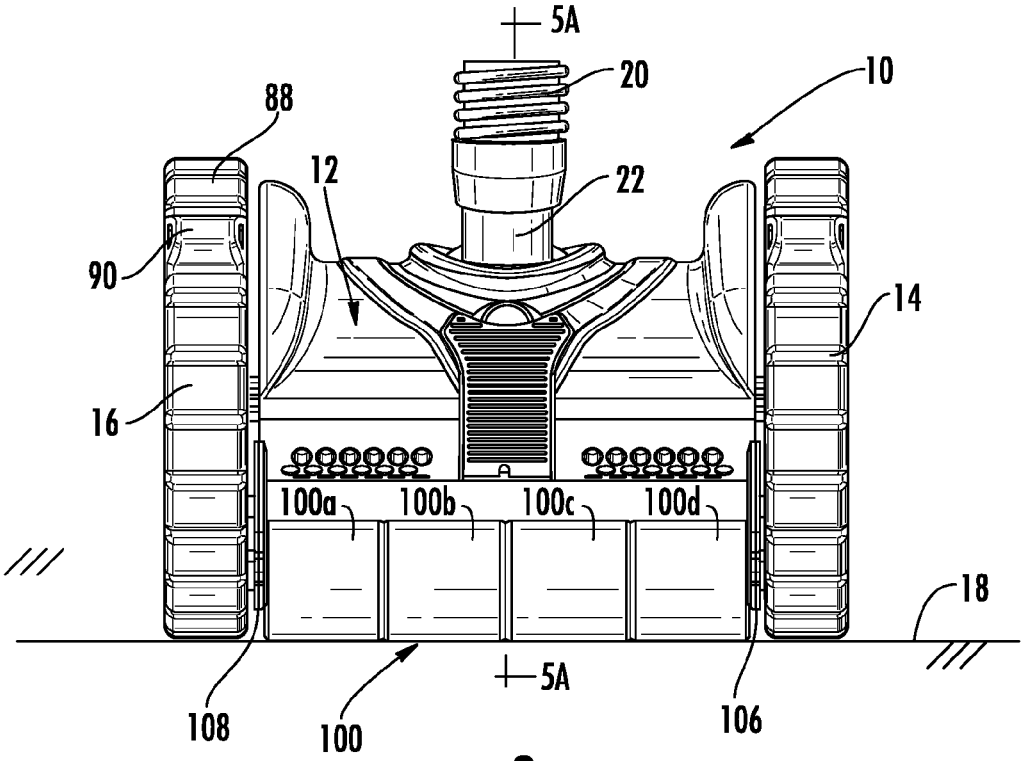
FIG. 2 is a front elevation view of the submersible swimming pool cleaner illustrated in FIG. 1.
Figure 3:
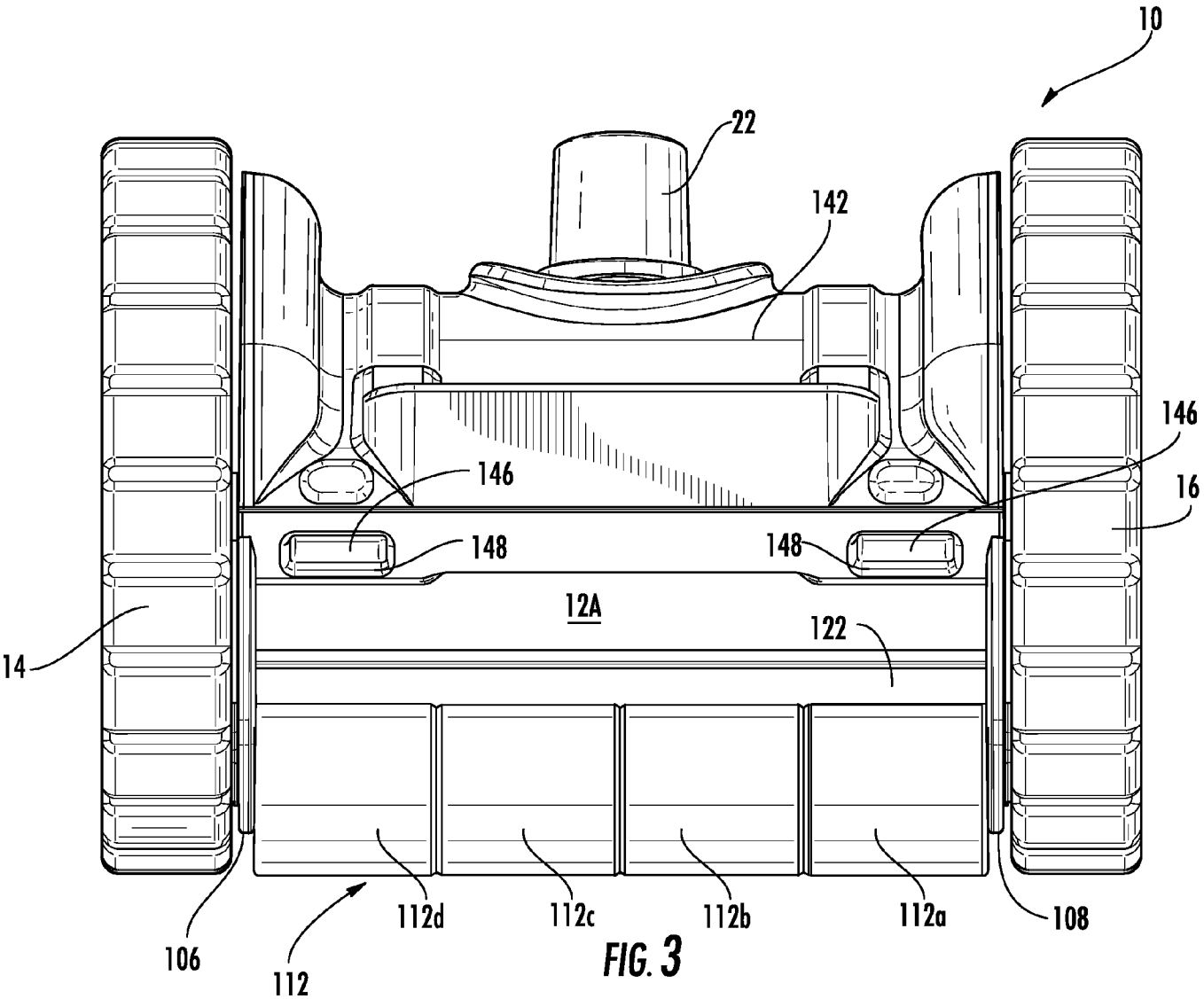
FIG. 3 is a rear elevation view of the embodiment of FIG. 1.
Figure 3A:
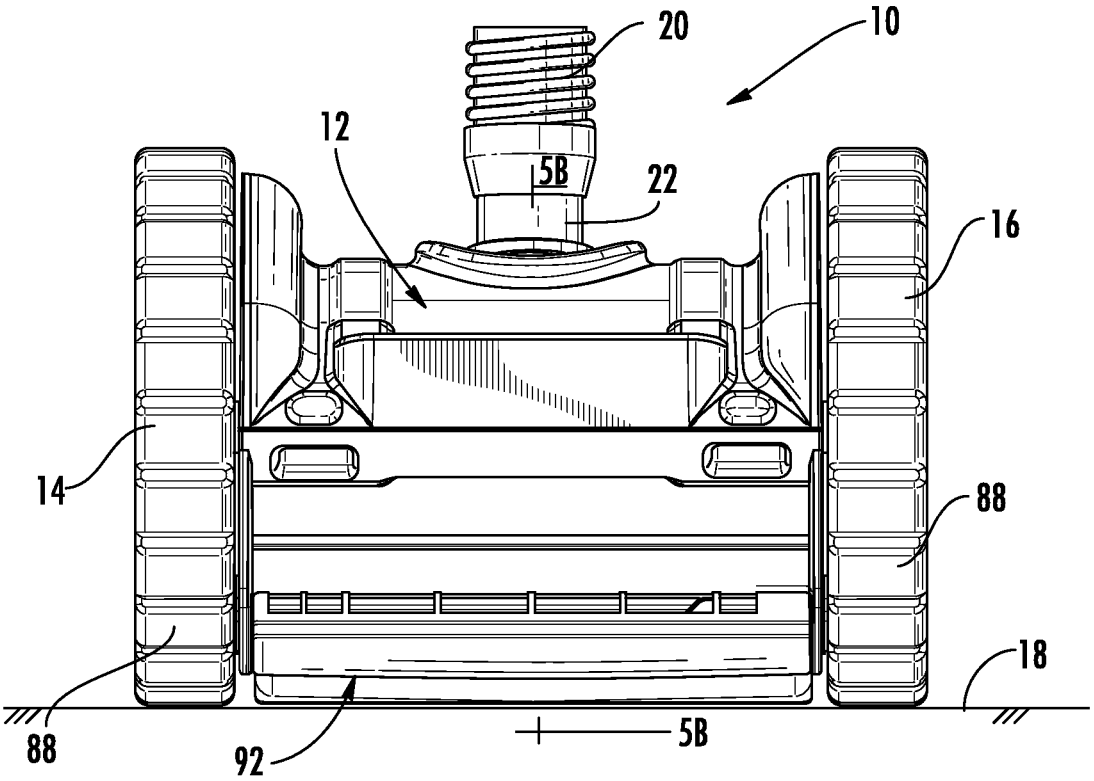
FIG. 3A is a rear elevation view of an alternate embodiment of FIG. 1, wherein a rear roller is replaced with a wiper element, such as a flap, by way of example.

The present invention will now be described more fully hereinafter with reference to the accompanying drawings, in which preferred embodiments of the invention are shown by way of example only. This invention may be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Referring initially to FIGS. 1-4, one embodiment of a pool cleaner 10 according to the teachings of the present invention is herein described by way of example. The pool cleaner 10 comprises a housing 12 and first and second wheels 14, 16 for moving the pool cleaner over a submerged surface 18 to be cleaned. The pool cleaner 10 is operable with a hose 20 connected to a hose connector 22 at one end and to a suction pump (not shown) at another end of the hose, as typically known in the industry.

As illustrated with reference to FIG. 5, a driving function is provided to the pool cleaner 10 by a water turbine 24 carried within a turbine housing 26. The turbine housing 26 includes a water flow chamber 28 formed by a chamber wall 30, as illustrated with reference to FIG. 6. The water flow chamber 28 includes inlet and outlet ports 32, 34 allowing a flow of water 36 through the chamber. The inlet port 32 is positioned for receiving water and debris from the submerged pool surface 18.

Figure 5:
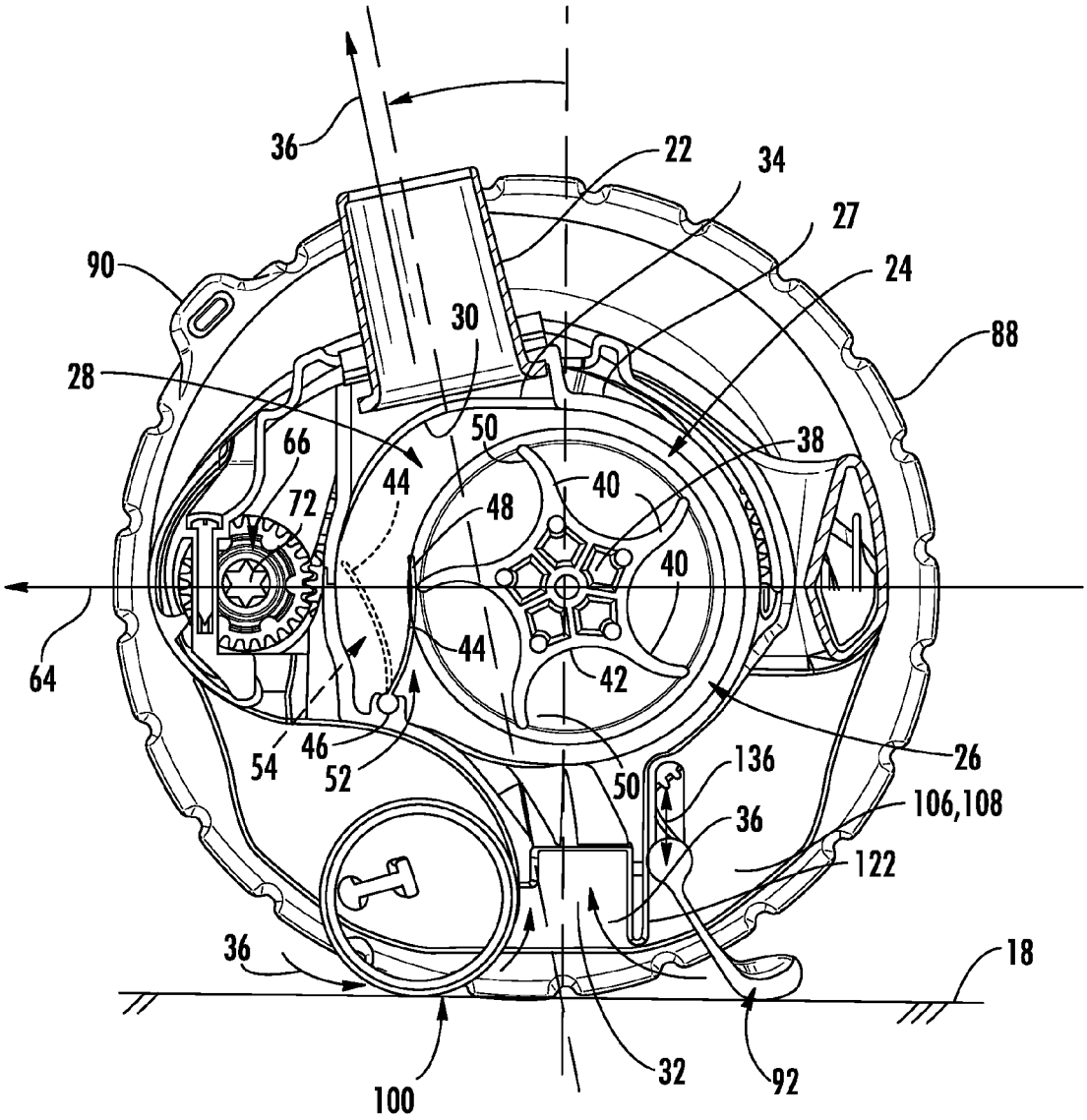
FIG. 5 is a cross-sectional view taken through lines 5B-5B of FIG. 3A.
Figure 6:
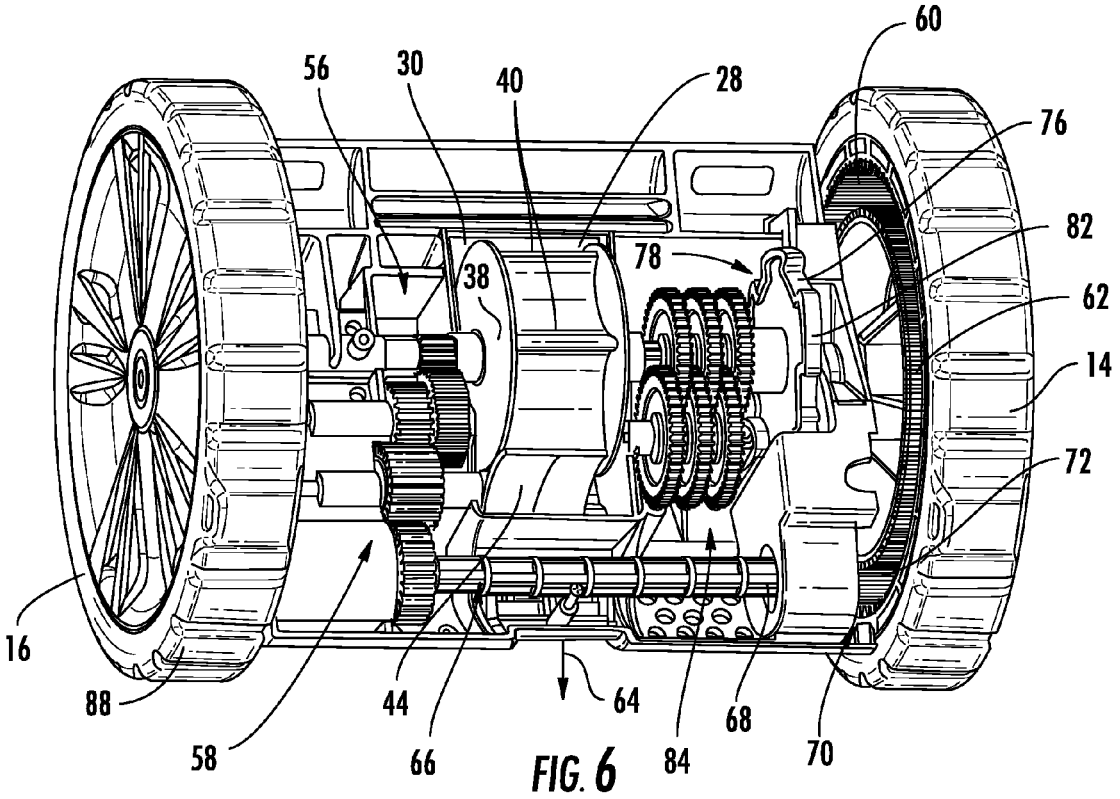
FIG. 6 is a top perspective view of the embodiment of FIG. 5 illustrated with the turbine housing cover including a hose connector removed for viewing the turbine.

With continued reference to FIGS. 5 and 6, a rotor 38 is rotatably mounted in the chamber 28 and spaced from the chamber wall 30 at all positions about the rotor to provide a flow path, as illustrated reference to the water flow 36 for water and debris around the rotor. A plurality of turbine rigid vanes 40 are rigidly attached about and extend from a periphery 42 of the rotor 38. As herein described, the rigid vanes 40 will be understood to have sufficient flexibility to accommodate passage of debris through the inlet port 32 without blockage, yet sufficiently rigid to accommodate volumes of water moving through the turbine chamber 28 for rotating the rotor 38. Many materials will come to the mind of those skilled in the art, now having the benefit of the teachings of the present invention. For the embodiment herein described by way of example, a valve element 44 is pivotal about a proximal end 46 of the valve element such that a distal end 48 is movable with respect to distal ends 50 of the turbine vanes 40. However, the valve element 44 may be flexible and fixed at its proximal end. The valve element 44 may be straight or have an arcuate shape. The valve element 44 is moveable between a first position 52 adjacent the vanes' distal ends 50 during rotation thereof and a second position 54 spaced from the vanes' distal ends and closer to the chamber wall 30 to allow passage of debris pieces of substantial size through the turbine 24. For the embodiment herein described by way of example, the valve element 44 is contoured creating less pressure on its convex side proximate the vanes 40 when water flows over it causing the valve element 44 to close a gap between the valve element and the vane distal ends 50 so as to maximizes power generated by the turbine 24. The valve element 44 and rotor 38 generally define a preferable opening for the flow passage through the chamber 28. The turbine 24 provides power to the wheels 14, 16 through linkages and provides power for steering, both of which occur as water and debris are drawn through the chamber 28 by the action of the suction pump.

Figure 7:
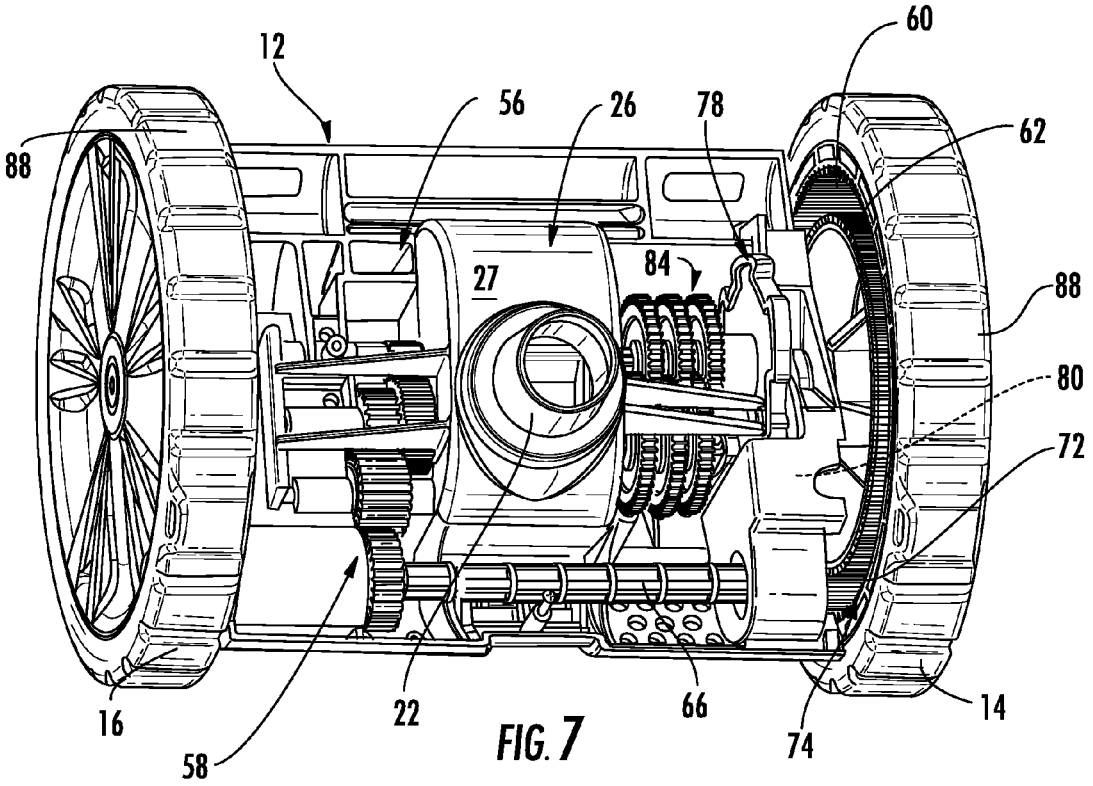
FIG. 7 is a partial top perspective view of the swimming pool cleaner of FIG. 1 illustrated with a top removable cover removed from the housing.
Figure 8:
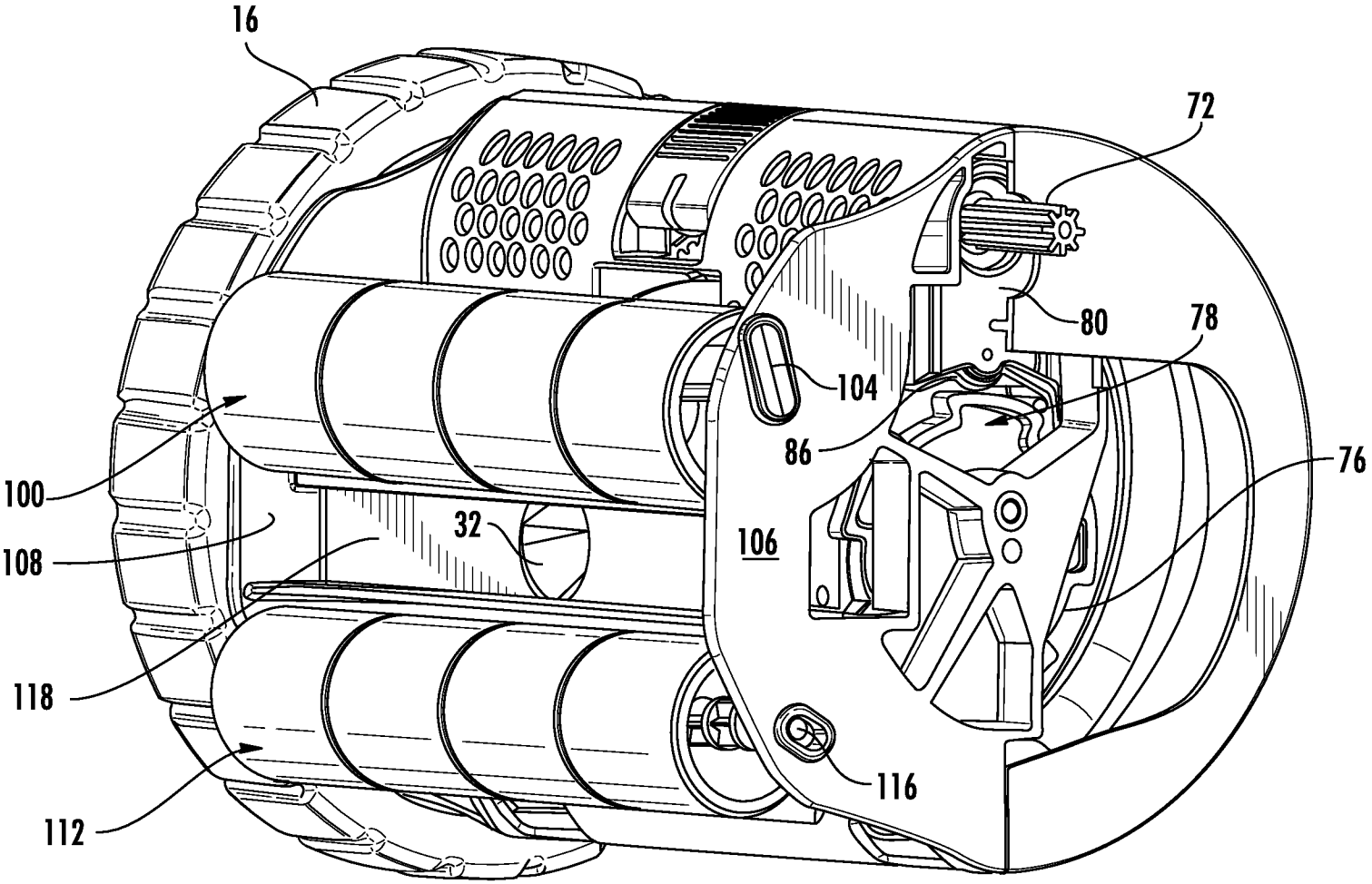
FIG. 8 is a bottom side perspective view of a partial embodiment of FIG. 1 having a wheel removed for viewing internal components.

The pool cleaner 10 includes a drive assembly 56 which uses the flow of water through the chamber 28 to create the rotary motion of the turbine 24 which is transferred to the wheels 14, 16 by a drive train 58 as illustrated with continued reference to FIG. 6 and now to FIG. 7. As is typical for such swimming pool cleaners, the flexible hose 20, described earlier with reference to FIG. 1, may be rotatably attached to the hose connector 22 and draws water from beneath the pool cleaner through the inlet port 32, turbine 24 and outlet port 34 through the hose connector.

As above described, the turbine 24 is the propulsion system of the pool cleaner 10. In typical pool cleaners, there is always a precise balance in the distance between the turbine and the wall 30 housing the turbine. If the distance is to close, debris will get trapped in between. If the distance is too great the turbine 24 will lose power and will not function as desired. With reference again to FIGS. 5 and 6, one embodiment of the invention further addresses this problem with the optional self-adjusting valve element 44. When debris flows through the turbine 24, it will push the valve element 44 out of the way and as a result the debris will not get trapped. Maximum power is attained without compromising function.

Figure 9:
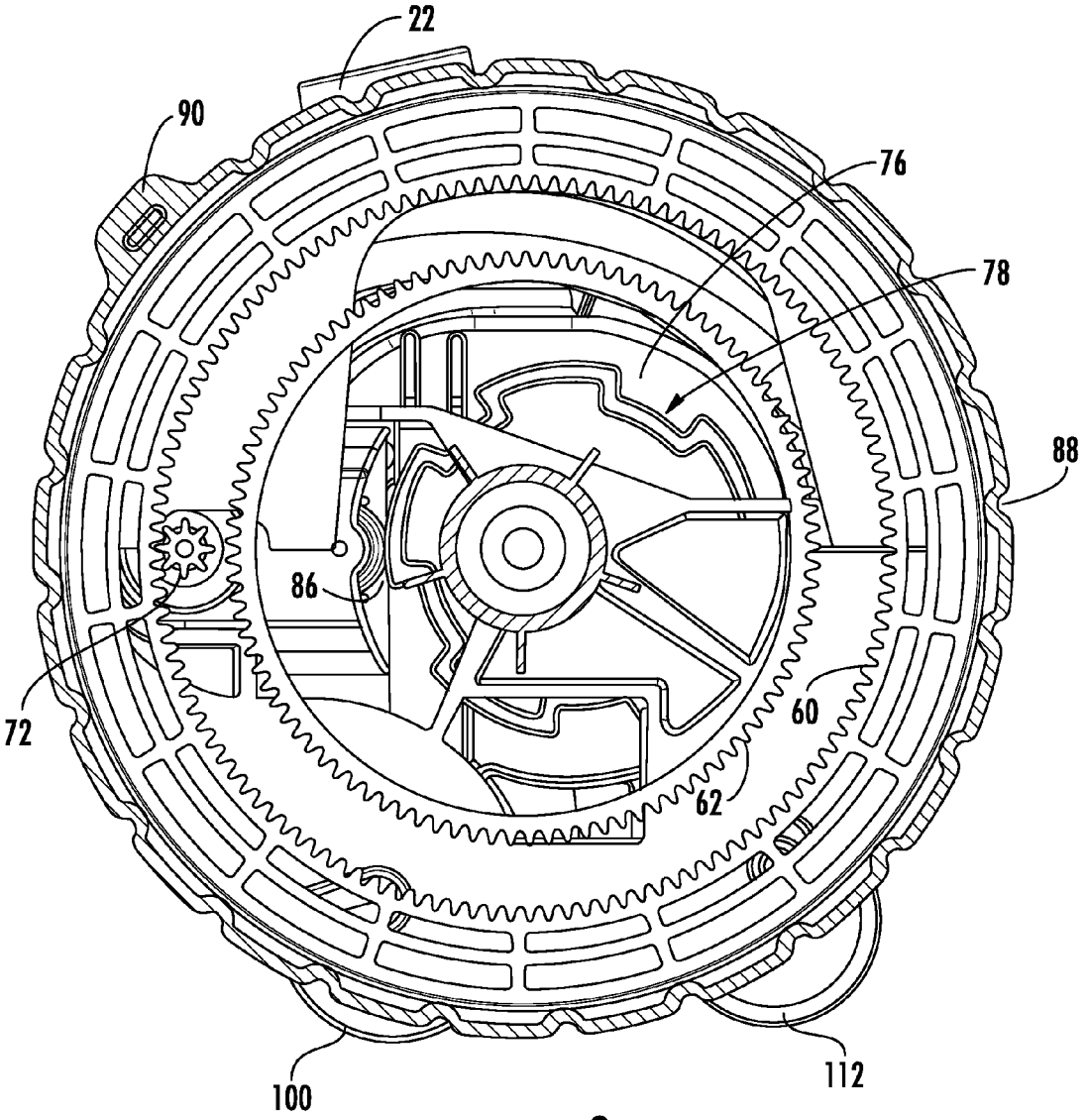
FIGS. 9 and 9A are cross-sectional views of FIGS. 1 and 3A, respectfully, proximate side portions including wheel and internal gearing portions within the housing.
Figure 9A:
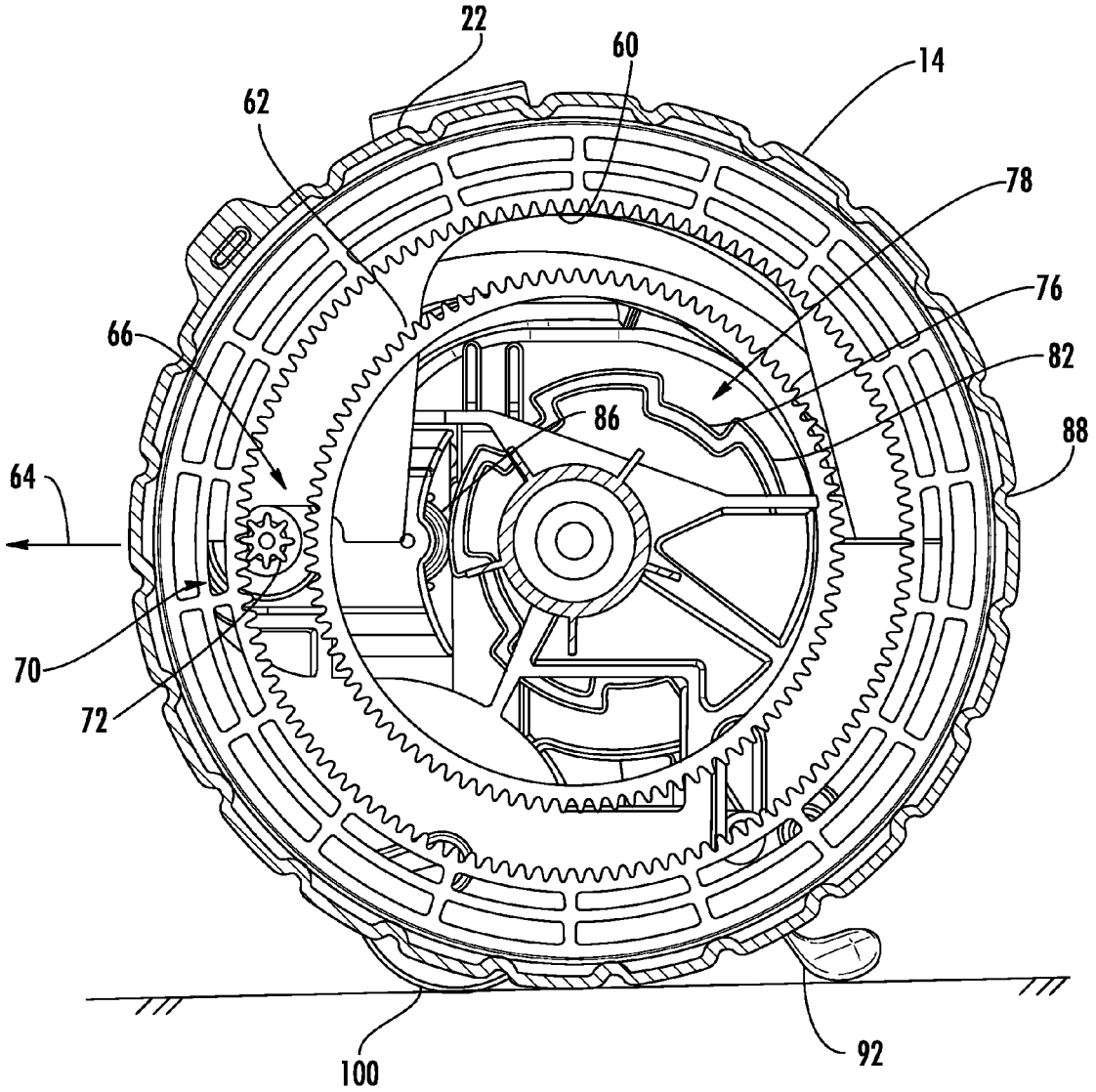
Figure 10:
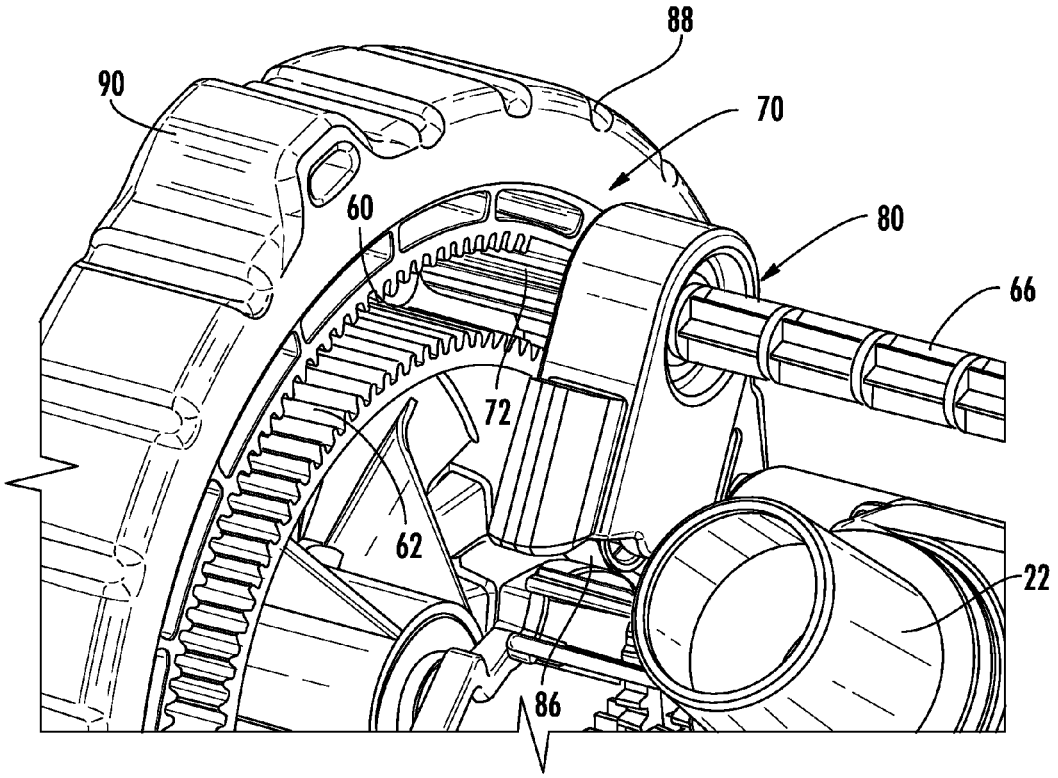
FIGS. 10 and 11 are partial perspective views illustrating a drive shaft engagement with primary and secondary wheel gears, respectively, for forward and steering rotation of one wheel.
Figure 11:
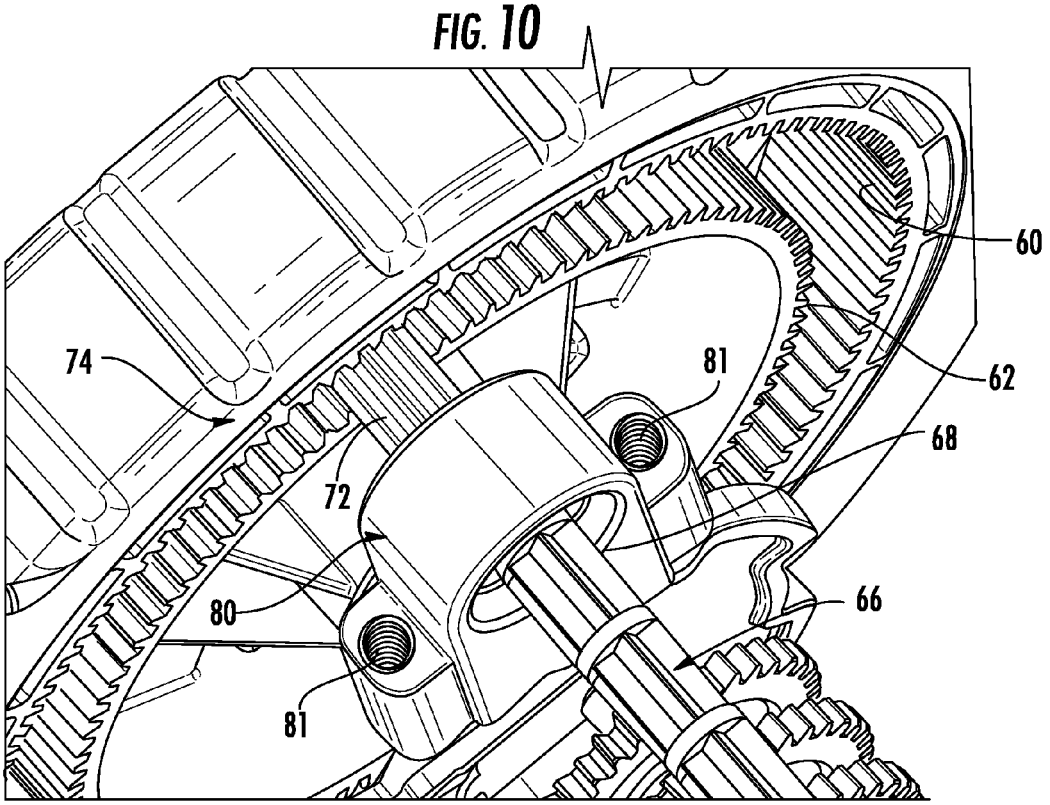
Figure 12:
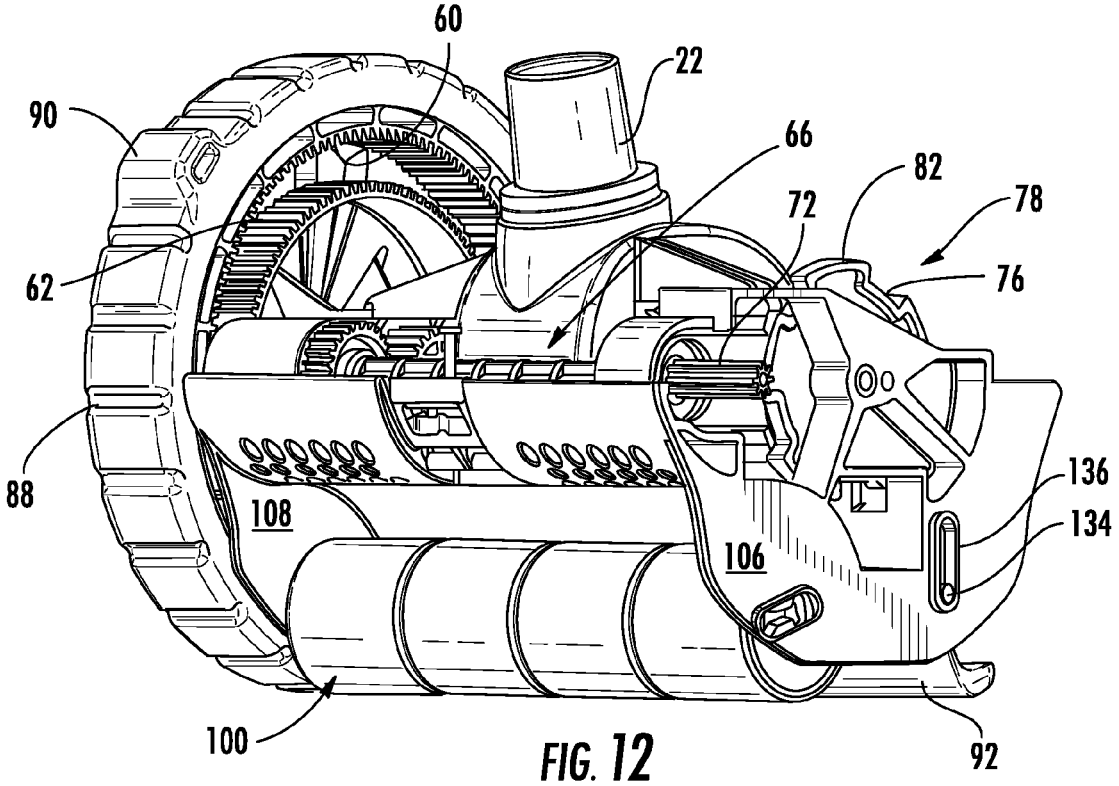
FIGS. 12 and 13 are partial perspective views illustrating a steering cam and drive shaft contactor assembly operable with the pool cleaners herein described.

With reference again to FIG. 6, the drive train 58 operable from the rotor 38 to primary wheel gears 60 of the first and second wheels 14, 16 provides synchronous rotation to both the first and second wheels for driving the pool cleaner along the surface 18 to be cleaned. The first wheel 14 comprises the primary wheel gear 60 radially spaced from a secondary wheel gear 62 opposing one another on an inside peripheral surface of the wheel 14. The second wheel comprises the primary wheel gear 60 on an inside surface of the wheel 16, as illustrated with reference to FIGS. 8-11. Commercially, both wheels 14, 16 comprise the primary 60 and secondary 62 wheel gears to accommodate replacement parts and efficiency in manufacturing, but only the first wheel 14 is used in the rerouting process. With continued reference to FIG. 6, the drive train 58 is operable with both the primary wheel gears 60 of the first and second wheels 14, 16 for driving the pool cleaner 10 in a first or forward direction 64 along the submerged surface 18 of the pool, as illustrated with reference again to FIG. 1. The drive train 58 includes a drive shaft 66 having one end 68 moveable between a driving position 70 when operable with the primary wheel gears 60 of the first and second wheels 14, 16 through pinion gears 72 at ends thereof and the steering position 74 when the drive shaft 66 contacts a lesser radius portion 76 of a cam 78, as illustrated with reference again to FIGS. 9-11. Such forward and reverse wheel gears 60, 62 are radially spaced from one another by a distance in excess of the diameter of the pinion gear 72 which alternately engages such gears on the one drive wheel 14. As illustrated with reference to FIGS. 10-12, a driveshaft contactor 80 contacts the cam 78 and the driveshaft one end 68 for movement of the one end of the driveshaft into and out of contact with the primary 60 and secondary 62 wheel gears. As will be appreciated by those of ordinary skill in the art, the direction of travel 64 of the pool cleaner 10 will change during the intermittent periods of a reverse rotation of the one wheel 14 by the drive shaft one end 68 driving the secondary gear 62. This steering function, together with the power provided by wheel drive provides a desired cleaning coverage of underwater pool surfaces.

Figure 13:
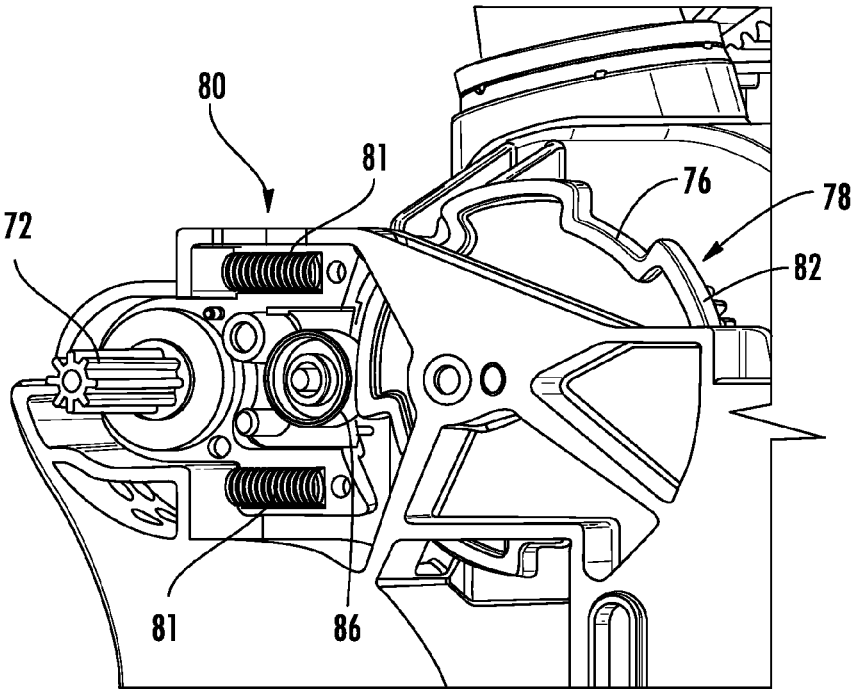
Figure 14:
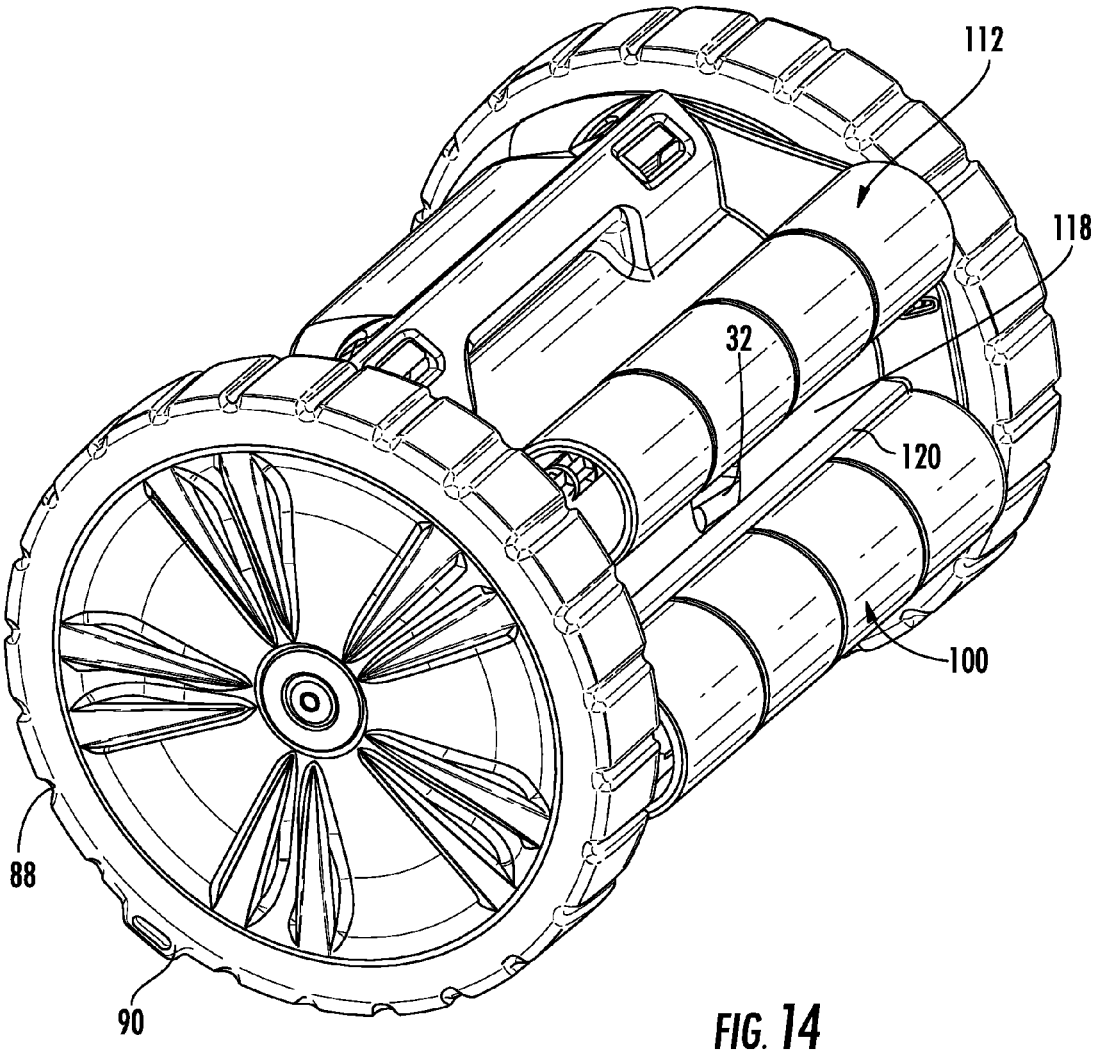
FIG. 14 is a bottom perspective view of the embodiment of FIG. 1.

The cam 78 has portions of greater 82 and the lesser 76 radii and is rotatable by the rotor 38 of the turbine 24 through reduction gears 84. The drive shaft contactor 80 extends from the cam 78 to the first wheel 14 and intermittently interrupts rotation of the first wheel and reverses its direction of rotation to thus cause a change in direction of movement of the pool cleaner 10. With reference again to FIGS. 8, 9 and 13, a contact roller 86 at one end of the drive shaft contactor 80 engages the cam 78 which determines driving and steering positions 70, 74 to provide forward or reverse movement of the wheels 14, 16. The drive shaft contactor 80 is biased into frictional engagement with the cam 78 using springs 81, as illustrated with reference to FIGS. 11 and 13. The pinion gear 72 engages the primary wheel gear 60 of the one wheel 14 in a forward moving of the pool cleaner 10, and in a steering movement, the pinion gear engages the secondary wheel gear 62 which results in reverse rotation of the one wheel 14. The intermittent movement of the drive shaft contactor 80 moves the drive shaft one end 68 and its pinion gear 72 which interrupts the synchronized rotation of the drive wheels 14, 16 and causes a turning of the pool cleaner 10. The cam 78 is rotatably supported on an extension of the rotor 38, as are the reduction gears 84 used for reducing rotational speed such that the cam 78 turns at a slower rate and provide the intermittent movement for a desirable period. As will be desired, the pool cleaner moves in the forward direction most of the time, and only intermittently change directions for short periods of time.

A tread element 88 is carried about the periphery of the drive wheels 14, 16 to provide traction on the pool surface 18 being cleaned. The tread element 88 in combination with the size of the drive wheels 14, 16 is larger in diameter than the housing 12 is high. This allows the pool cleaner 10 to ride over commonly encountered impediments and obstacles in a swimming pool.

With reference again to FIGS. 1 and 5, a protrusion 90 is affixed at a portion of the tread element 88 of each wheel 14, 16 and provides additional traction for dislodgement of the pool cleaner. The large wide wheels with one protrusion on each help dislodge the pool cleaner 10 in the event it gets stuck on objects in a pool.

Figure 4D:
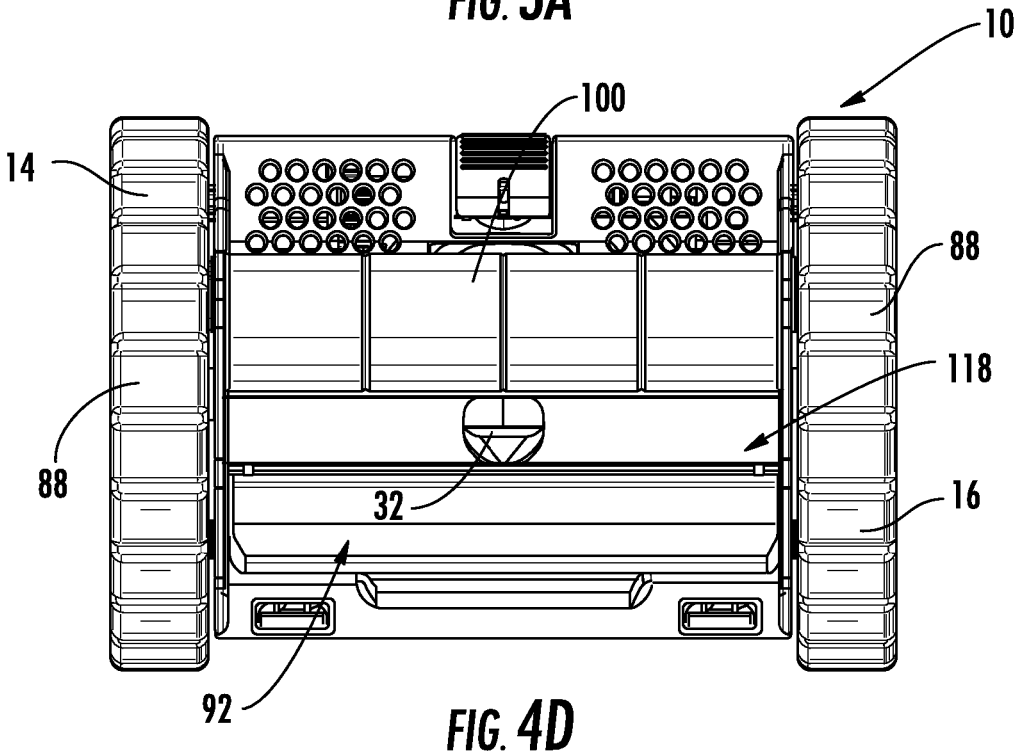
FIG. 4D is a bottom plan view of the embodiment of FIG. 3A.
Figure 4:
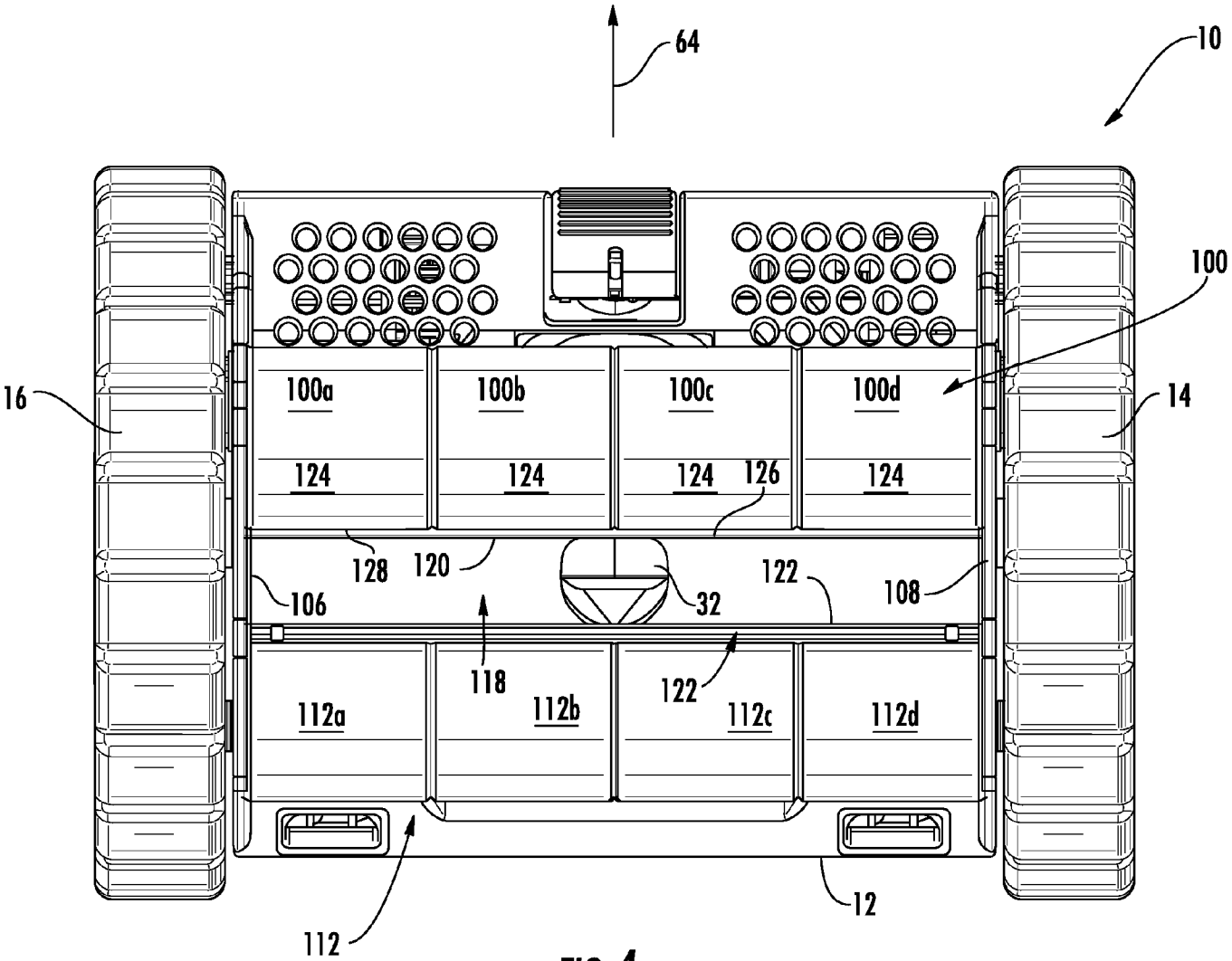
FIG. 4 is a bottom view of the embodiment of FIG. 1.
Figure 4A:
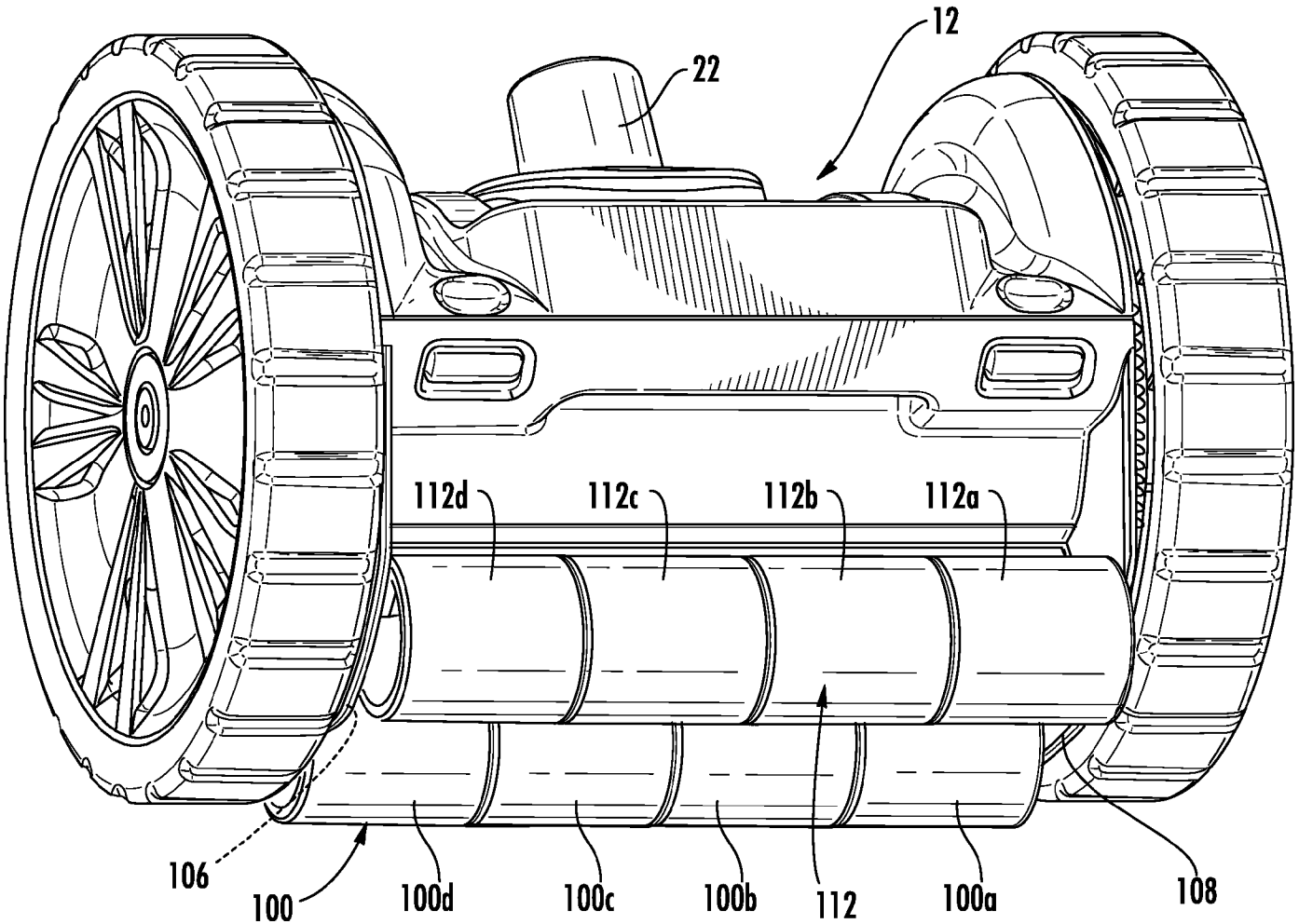
FIG. 4A is a bottom perspective of the embodiment of FIG. 1
Figure 4B:
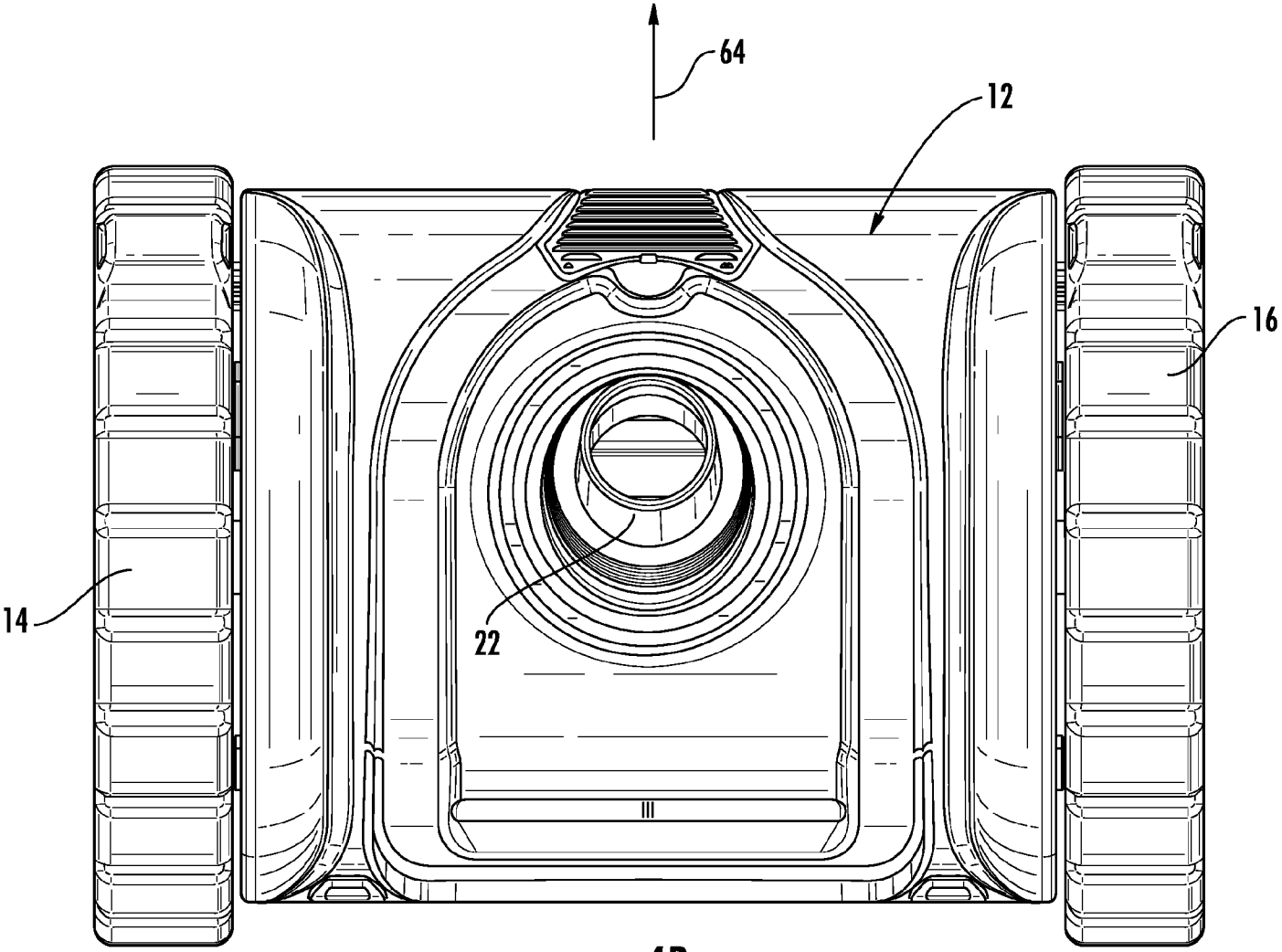
FIG. 4B is a top view of the embodiment of FIG. 1.
Figure 5A:
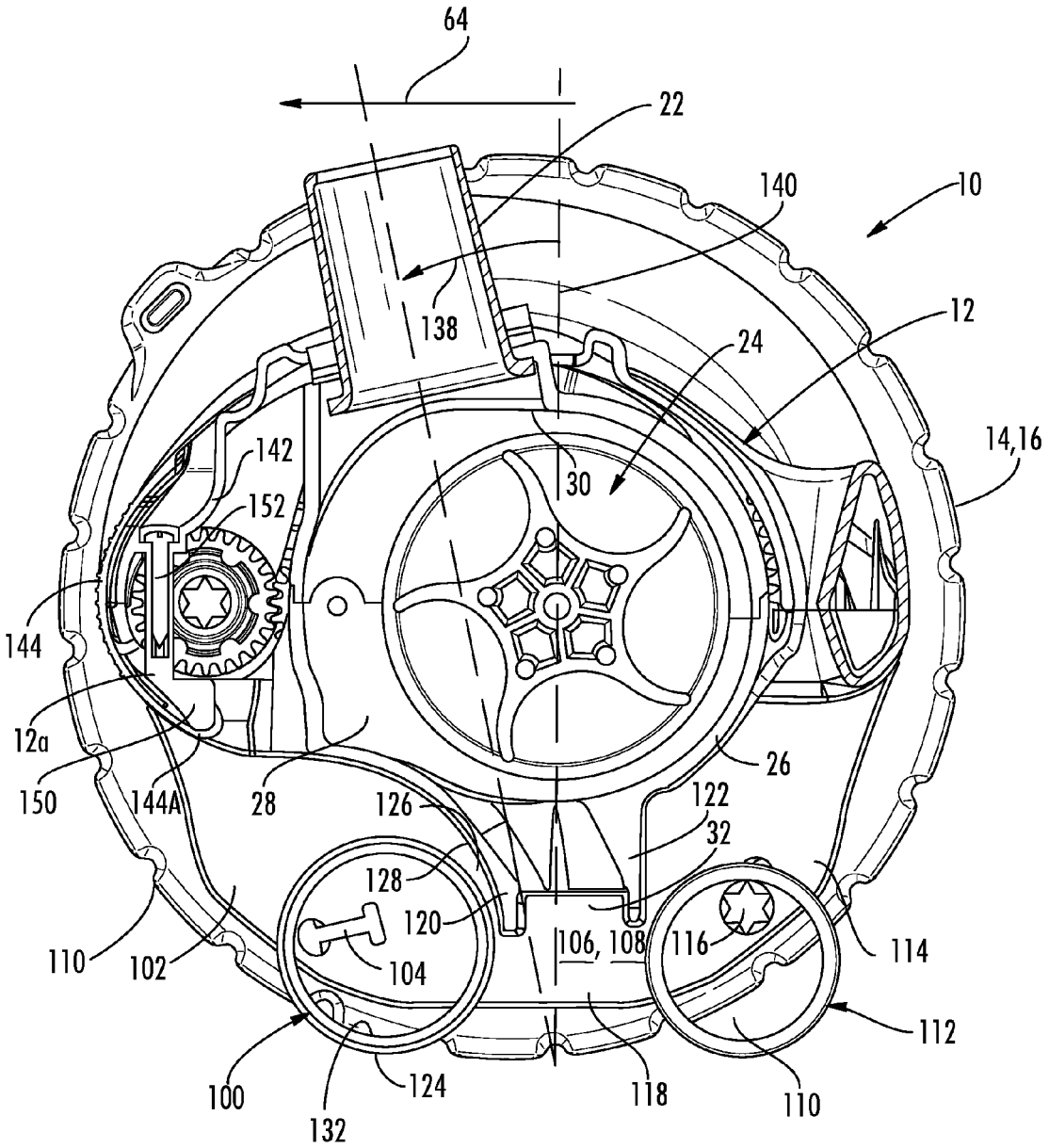
FIG. 5A is a cut-away side view taken through lines 5A-5A of FIG. 2 is a first position having forward and aft rollers extending outside a perimeter of the wheel.
Figure 5B:
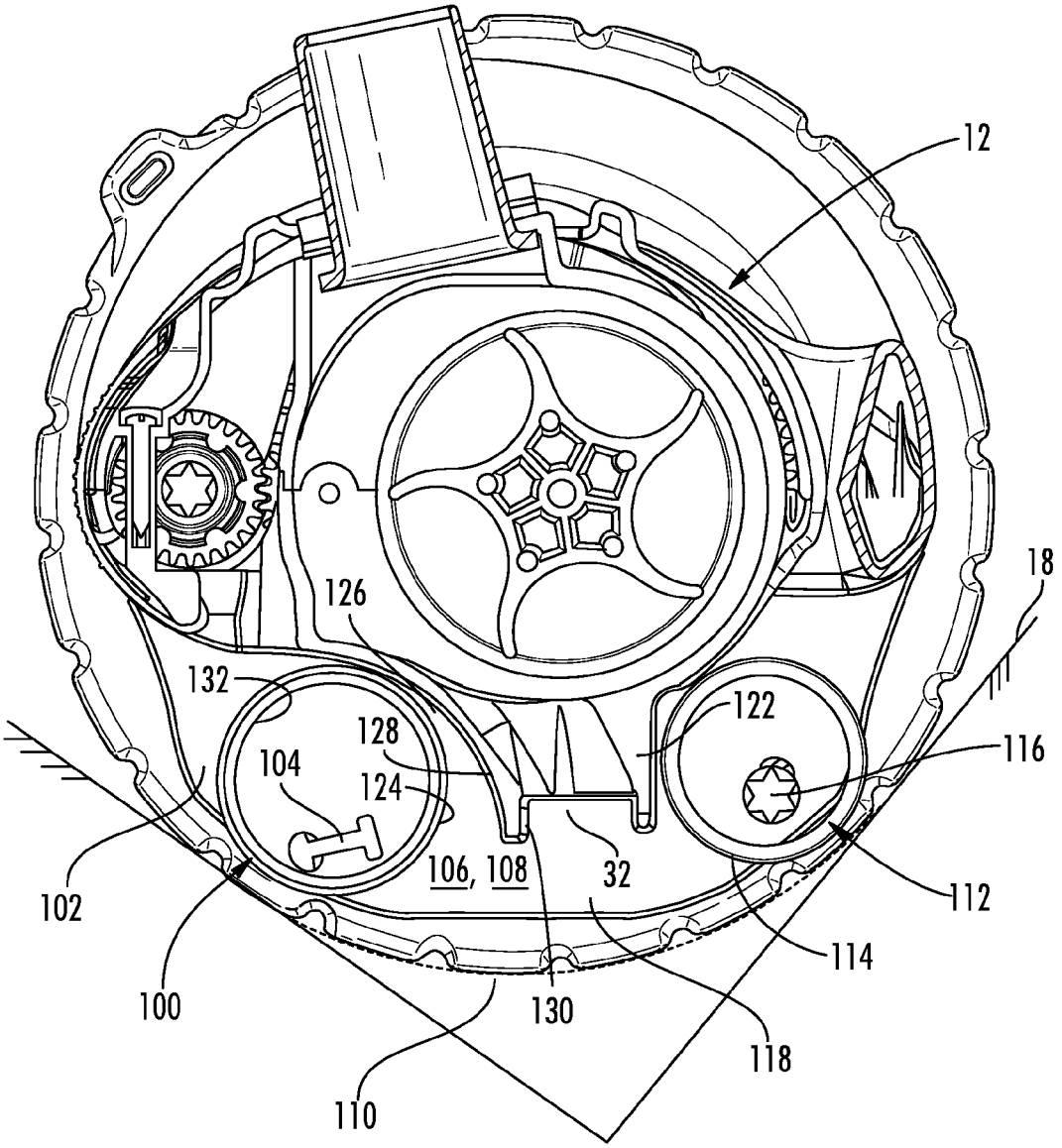
FIG. 5B a cut-away view illustrating the rollers retracted within the perimeter of the wheels.

With reference again to FIGS. 1 and 2 and now to FIGS. 4A and 5A, by way of example, a first roller 100 is positioned on a forward bottom portion 102 of the housing 12 forward the inlet port 32, The first roller, herein a forward roller 100 is moveable about a first axle 104 carried between opposing side wall portions 106, 108 of the housing 12 for retracting within a perimeter 110 defined by radial outermost portions of the at least two wheels 14, 16, as further described with reference to FIG. 5B.

With continued reference to FIGS. 4A and 5A, a second roller 112 is positioned at an aft bottom portion 114 of the housing 12 aft the inlet port 32 and generally opposing the first roller 100. The second roller 112 (herein an aft roller) extends between the opposing side wall portions 106, 108 and is moveable about a second axle 116. The second roller 112 is moveable from outside the perimeter 110 for contact with the surface to be cleaned 18 to inside the perimeter, as illustrated with reference again to FIG. 5B, for permitting the second roller to roll along uneven portions of the submerged surface 18 to be cleaned. The first and second rollers 100, 112, in combination with the opposing side wall portions 106, 108 of the housing 12, form a plenum 118 for water, where the plenum of water enhances adherence of the pool cleaner to the submerged surface 18.

With reference again to FIGS. 1, 2 and 4A, by way of example, the rollers 100, 112 comprise multiple roller portions 100 *a, b, c, d* and 112 *a, b, c, d*, wherein each of the multiple roller portions moves independently of one another about the axles 104, 116, respectively, for generally conforming to the uneven portions of the surface 18 to be cleaned. Further, rollers 100, 112 are loosely rotatable about their respective axles 104, 116.

With reference again to FIGS. 4, 5A and 5B, a forward partition 120 and an aft partition 122 extend between the opposing side wall portions 106, 108. The forward partition 120 is fixed forward the inlet port 32 and the aft partition 122 is fixed aft the inlet port, wherein free ends of the partitions extend toward the perimeter 110 but only extend to inside the perimeter, thus spaced from the perimeter. An outer surface 124 of the first roller 100 continuously forms a fixed gap 126 with an outer surface 128 of the forward partition 120 during movement of the first roller 100 from outside to inside the perimeter 110, as further illustrated with reference again to FIG. 5B. As herein illustrated, the outer surface 128 of the forward partition 120 has an arcuate shape extending from the free end 130 of the forward partition toward the forward direction 64 of movement of the pool cleaner. As further illustrated, in one commercial embodiment, the rollers 100, 112 are formed from tubes having their inner surfaces loosely slidable along their respective axles during rotation. For the first roller 100, its inner surface 132 is dimensioned to maintain the gap 126 during movement of the first roller from outside the perimeter 110 to inside the perimeter. For providing reinforcement to the first axle 104, the first axle is formed as a rib having an elongate cross section, as illustrated with continued reference to FIG. 5A.

As above described with reference to the first and second rollers 100, 112, with use of the wiper element 92 instead of the second roller 112, the side wall portions 106, 108, front/first roller 100 and the wiper element 92 create the plenum 118 by essentially forming a skirt around the inlet port 32 enabling the cleaner 10 to have enhanced suction and thus enhanced attachment to the pool surface 18. Since the rollers 100, 112 move freely, they are able to retract within the outside perimeter 110 of the wheels 14, 16 and have little resistance which enables the cleaner 10 to desirably transition into steep or angled walls. As above described, the rollers 100, 112 having multiple segments moving independently of one another further enable them to conform to uneven surfaces in the pool. This also enables the cleaner 10 to navigate over obstacles such as bottom drains and larger debris. The rollers or roller and wiper in combination with the housing lower side wall portions keep the plenum substantially closed, thus providing a desirable flow and collection of debris from beneath the pool cleaner by a suction action.

As illustrated with reference again to FIGS. 5 and 12, the wiper element 92 comprises a hinge pin 134 slidable in an aperture 136 in the side wall portions 106, 108. The apertures 136, herein slots 136, allow the hinge pin 134 and thus the wiper element 92 to move up and down or in and out within and beyond the perimeter 110. The slot 136 allows the wiper element 92 to be recessed within the perimeter 110 of the wheels 14, 16, and thus avoid a locking against the surface 18 being cleaned which would be the case if the wiper element 92 were fixedly hinged. Those of skill in the art will appreciate that the aperture 136 may be an elongate hole, an oval, or the like, now having the benefit of the teachings of the present invention. The wiper element 92 is therefore able to conform to uneven surfaces. The retraction of the wiper element 92 enhances capability of the cleaner 10 to right itself. When in the process of righting itself, the wiper element 92, or the second roller 112 above described, will retract within the perimeter 110 of the wheels 14, 16 allowing the cleaner 10 to upright itself without obstruction. In an alternate embodiment, the wiper element comprises multiple elements operable with the hinge pin 134, as earlier described for the rollers 110, 112.

With continued reference to FIG. 5, the aft partition 122 is in close proximity to a proximal end of the wiper element, yet preferably not in frictional contact. Further, the outside surface of the roller 100 is in close proximity, yet preferably not in frictional contact with the forward partition 120, thus desirably maintaining the gap 126. Such an arrangement creates a sufficient seal for improved performance of the pool cleaner, as above described.

Figure 8A:
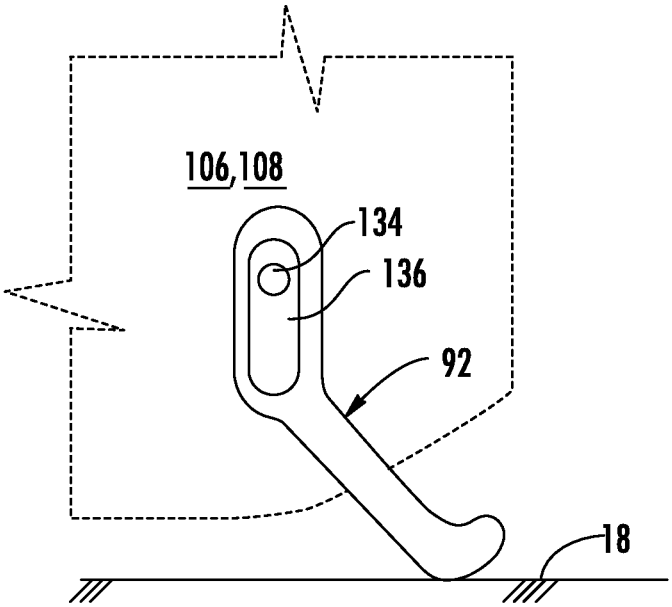
FIG. 8A is a partial end view of a flap having a slot for slidably receiving a hinge pin therein as an alternate embodiment.

As will come to the mind of those skilled in the art, now having the benefit of the teachings of the present invention, one embodiment of the wiper element 92 may include the aperture as the slot 136 carried within the proximal end of the wiper element 92 and slidable along a fixed hinge pin, as illustrated with reference to FIG. 8A, wherein the hinge pin may be fixed to the side wall portions 106, 108 as earlier described.

Figure 4C:
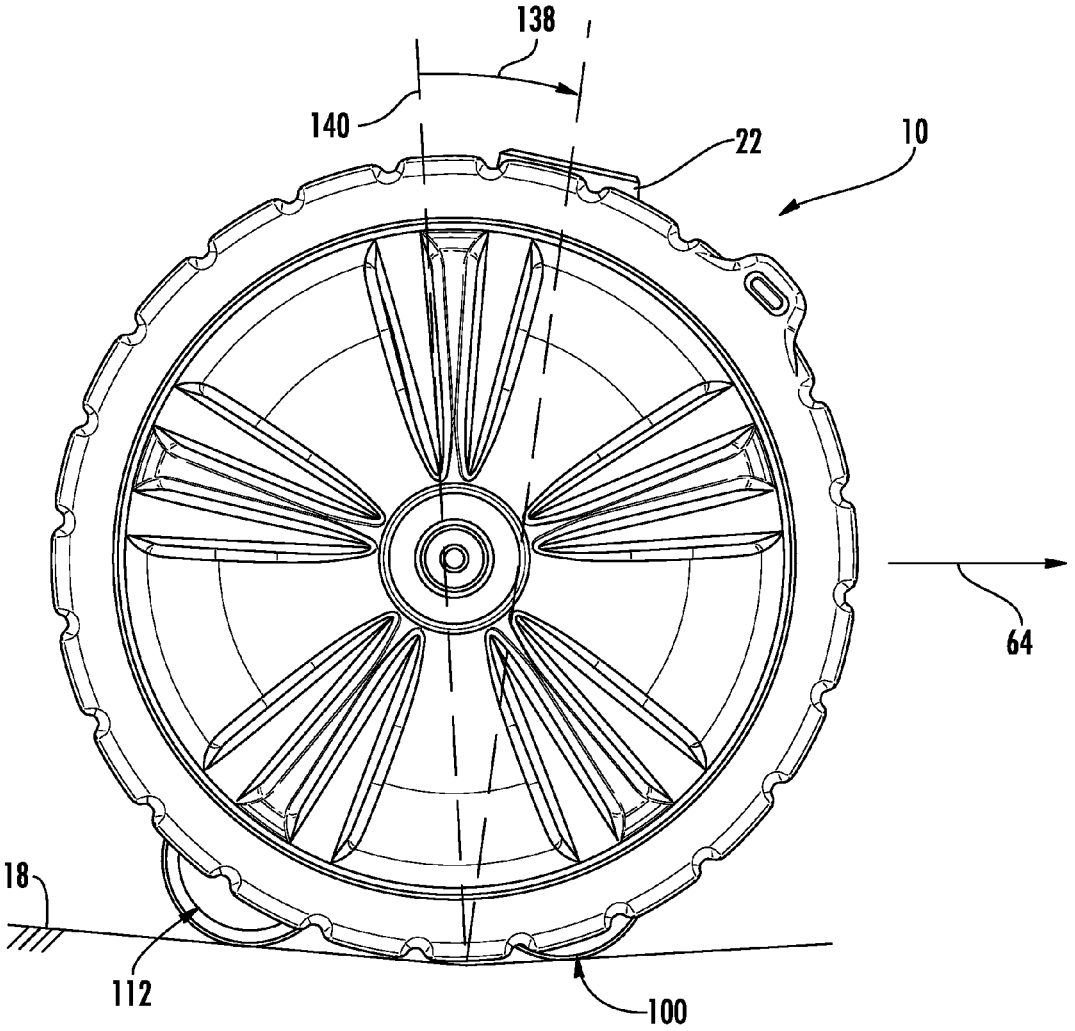
FIG. 4C is a side elevation view of the embodiment of FIG. 1.

Typical pool cleaners that are able to transition onto the pool side walls have problems climbing above the water line and therefore suck air which is well known to be detrimental for the pump. The embodiment of the pool cleaner 10, herein described by way of example, solves this problem by forwardly angling 138 the hose connector 22 relative to an upright position 140 of the pool cleaner during normal operation, as illustrated with reference again to FIGS. 4C and 5A. As a result of the forwardly angled 140 hose connector 22, when the cleaner 10 climbs a side wall, the hose 20 will be placed slightly ahead of the cleaner 10. Since the hose 20 is full of water during operation of the cleaner 10, the hose acts as a weight forcing the cleaner to generally stay submerged and below the water surface level of the pool, thus preventing the pool cleaner from adversely sucking air.

Figure 15A:
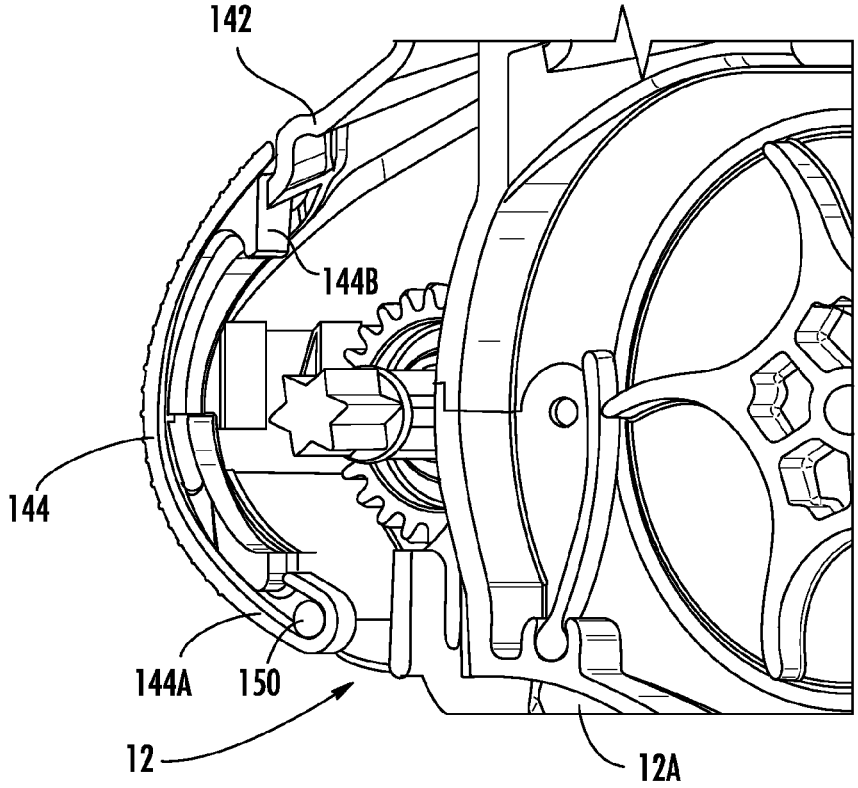
FIGS. 15A and 15B are partial perspective and side cross-sectional views, respectively, of internal portions of the swimming pool cleaner of FIG. 1, illustrating a latch connection for securing a housing cover onto a lower body portion.
Figure 15B:
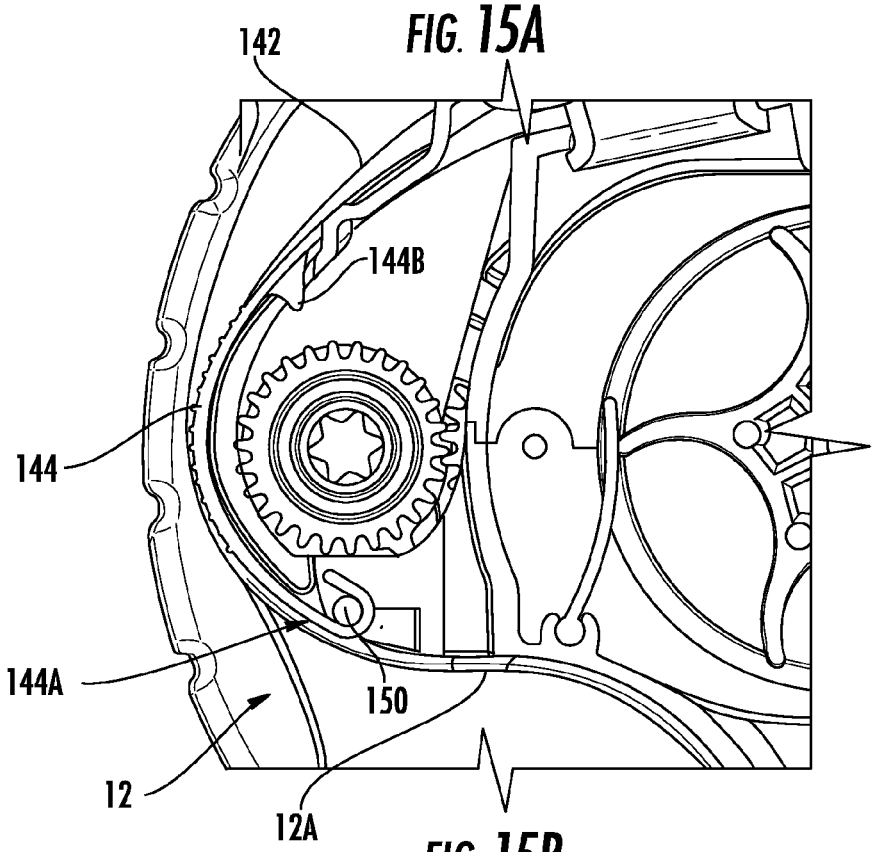
Figure 16:
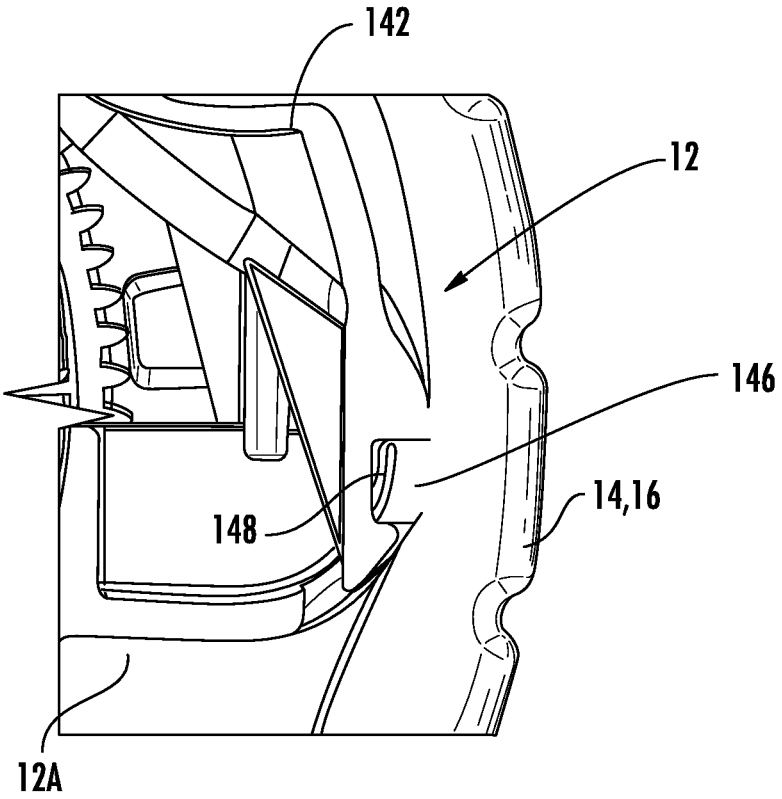
FIG. 16 is a partial cross-sectional view illustrating a rearward portion of the swimming pool cleaner housing and connection to a wall of housing portion thereof.

As illustrated with reference again to FIGS. 1 and 3, and now to FIGS. 15A, 15B and 16, the housing 12 comprises a top cover 142 connected to a housing bottom portion 12A with a front latch 144, rear tab 146 and slot 148. The tabs 146 are placed into the slots 148 on the rear portion of the body 12 of the pool cleaner 10. The cover 142 is then latched at the front end of the pool cleaner 10 using the front latch 144. As illustrated with continued reference to FIGS. 15A and 15B, the latch 144 comprises a hooked portion 144A at a lower end removably secured to a pin or optional detent 150 fixed to a lower portion 12A of the housing 12. An upper portion of the latch 144 comprises a protrusion 144B that is removably secured to a portion of the cover 142. A screw 152 may also be used to secure the top cover 142 to the lower housing portion 12A.

Many modifications and other embodiments of the invention will come to the mind of those skilled in the art now having the benefit of the teachings presented in the foregoing descriptions and associated drawings. Therefore, it is understood that the invention is not to be limited to specific embodiments disclosed, and that modifications and embodiments are intended to be included within the scope of the appended claims.

That which is claimed is:

1. A pool cleaner driven by a flow of water therethrough for operation along a submerged surface to be cleaned, the pool cleaner comprising:

a housing having an inlet port and an outlet port, wherein suction applied to the outlet port results in suction at the inlet port for receiving water and debris therethrough;

at least two wheels rotatably carried by the housing for rolling along a submerged surface to be cleaned, wherein an outer diameter of the at last two wheels defines a perimeter thereof;

a first roller positioned on a bottom portion of the housing forward the inlet port, the first roller having a tubular shape defined by an outer surface and an inner surface;

a first axle carried between opposing side wall portions of the housing, wherein the inner surface of the first roller is slidably rotatable about the first axle, and wherein an outside dimension of the first axle is sufficiently smaller that a diameter of the inner surface for permitting the first roller to extend beyond the perimeter and for retracting the first roller within the perimeter responsive to movement along the submerged surface; and a second roller positioned at the bottom portion of the housing aft the inlet port and generally opposing the first roller, the second roller extending between the opposing side wall portions and moveable about a second axle, the second roller moveable from outside the perimeter for contact with the surface to be cleaned to inside the perimeter for permitting the second roller roll along uneven portions of the submerged surface to be cleaned, wherein the first and second rollers, in combination with the opposing side wall portions of the housing, form a plenum for water, the plenum enhancing adherence of the pool cleaner to the submerged surface to be cleaned.

2. The pool cleaner according to claim 1, wherein the at least two wheels comprise only two wheels, each rotatable about a common axis of rotation.

3. The pool cleaner according to claim 1, wherein the first roller comprises multiple roller portions, and wherein each of the multiple roller portions moves independently of one another about the first axle for generally conforming to the uneven portions of the surface to be cleaned.

4. The pool cleaner according to claim 1, wherein the first axle is rigidly attached to the side wall portions.

5. The pool cleaner according to claim 1, further comprising a forward partition and an aft partition extending between the opposing side wall portions, the forward partition fixed forward the inlet port and the aft partition fixed aft the inlet port, wherein free ends of the partitions extend toward the perimeter and are spaced therefrom.

6. The pool cleaner according to claim 5, wherein the outer surface of the first roller is maintained out of contact with the forward partition during movement thereof.

7. The pool cleaner according to claim 6, wherein the outer surface of the forward partition comprises a concave shape extending from the free end thereof toward a forward direction of movement of the pool cleaner.

8. The pool cleaner according to claim 1, wherein the first axle comprises a rib having an elongate cross section, the rib extending radially outward and substantially along a full length of the axle.

9. The pool cleaner according to claim 1, wherein the second roller comprises multiple second roller portions independently moveable about the second axle.

10. The pool cleaner according to claim 9, wherein the second roller comprises a tubular shape, and wherein the tubular shaped second roller includes an inner surface loosely slidable about the second axle.

11. The pool cleaner according to claim 1, further comprising a turbine including:

a water flow chamber formed by a chamber wall, the water flow chamber communicating with the inlet and outlet ports for allowing a flow of water through the chamber;

a rotor rotatably mounted in the chamber and spaced from the chamber wall at all positions thereabout to provide a flow path for water and debris around the rotor; and a plurality of rigid vanes fixedly attached to and extending from the rotor.

12. The pool cleaner according to claim 11, further comprising a valve element having a distal end movable with respect to the vanes between a first position proximate free ends of the vanes during rotation thereof and a second position spaced from the vanes to allow passage of debris through the turbine.

13. The pool cleaner according to claim 1, further comprising a hose connector operable with the outlet port, wherein the hose connector is angled toward a forward direction of movement of the pool cleaner during operation thereof, whereby a hose connected to the hose connector will be placed slightly ahead of the housing when climbing a generally vertical wall portion of the surface to be cleaned, the hose having water therein thus providing increased weight for keeping the housing below a water surface level of a pool to prevent a sucking of air at the inlet port.

14. A pool cleaner driven by a flow of water therethrough for operation along a submerged surface to be cleaned, the pool cleaner comprising:

a housing having an inlet port and an outlet port, wherein suction applied to the outlet port results in suction at the inlet port for receiving water and debris therethrough;

at least two wheels rotatably carried by the housing for rolling along a surface to be cleaned, wherein an outer diameter of the at last two wheels defines a perimeter thereof;

a roller positioned on a bottom portion of the housing forward the inlet port, the roller having a tubular shape defined by an outer surface and an inner surface;

a first axle carried between opposing side wall portions of the housing, wherein the inner surface of the roller is slidably rotatable about the first axle, and wherein an outside dimension of the first axle is sufficiently smaller that a diameter of the inner surface for permitting the roller to extend beyond the perimeter and for retracting the roller within the perimeter of the at least two wheels responsive to movement along the submerged surface; and a retractable element positioned at the bottom portion of the housing aft the inlet port and generally opposing the roller, the retractable element extending between the opposing side walls and moveable about a second axle, the retractable element moveable from outside the perimeter for contact with the surface to be cleaned to inside the perimeter for permitting the retractable element to slide along uneven portions of the surface to be cleaned, wherein the retractable element and the roller in combination with the opposing side wall portions of the housing form a plenum for water and enhancing adherence of the pool cleaner to the surface to be cleaned.

15. The pool cleaner according to claim 14, wherein the at least two wheels comprise only two wheels.

16. The pool cleaner according to claim 14, wherein the roller comprises multiple roller portions, and wherein each of the multiple roller portions moves independently of one another about the first axle for generally conforming to the uneven portions of the submerged surface to be cleaned.

17. The pool cleaner according to claim 14, further comprising a forward partition and an aft partition extending between the opposing side wall portions, the forward partition fixed forward the inlet port and the aft partition fixed aft the inlet port, wherein free ends of the partitions extend toward the perimeter and are spaced therefrom.

18. The pool cleaner according to claim 17, wherein the outer surface of the roller is maintained out of contact with the forward partition.

19. The pool cleaner according to claim 18, wherein the outer surface of the forward partition comprises a concave shape extending from the free end thereof toward a forward direction of movement of the pool cleaner.

20. The pool cleaner according to claim 14, wherein the retractable element comprises a flap rotatable about the second axle, and wherein at least one of the second axle and the flap is slidable within slots formed within at least one of the side wall portions and the flap.

21. The pool cleaner according to claim 14, wherein the roller comprises a first roller and the retractable element comprises a second roller.

22. The pool cleaner according to claim 21, wherein each of the first and second rollers comprises multiple tubular roller portions.

23. The pool cleaner according to claim 14, further comprising a turbine carried between the inlet and outlet ports for receiving a flow of water therepast for driving a rotor operable for providing a driving force to the at least two wheels.

24. The pool cleaner according to claim 14, further comprising a hose connector operable with the outlet port, wherein the hose connector is angled toward a forward direction of movement of the pool cleaner during operation thereof, whereby a hose connected to the hose connector will be placed slightly ahead of the housing when climbing a generally vertical wall portion of the surface to be cleaned, the hose having water therein thus providing increased weight for keeping the housing below a water surface level of a pool to prevent a sucking of air at the inlet port.

25. A pool cleaner driven by a flow of water therethrough for operation along a submerged surface to be cleaned, the pool cleaner comprising:

a housing having an inlet port and an outlet port, wherein suction applied to the outlet port results in suction at the inlet port for receiving water and debris therethrough;

two opposing wheels rotatably carried by the housing for rolling the housing along a submerged surface to be cleaned in a forward direction of movement, wherein an outer diameter of each of the two opposing wheels defines a perimeter, and wherein the housing is fully carried within the perimeter;

rollers carried at a bottom portion of the housing forward and aft the inlet port, wherein the rollers are movable beyond the perimeter and retractable within the perimeter responsive to movement along the submerged surface; and a hose connector operable with the outlet port, wherein the hose connector is attached to the housing at an angle fixedly inclined toward the forward direction of movement such that a hose connected to the hose connector will be placed slightly ahead of the housing when climbing a generally vertical submerged wall surface to be cleaned, and wherein the hose containing water during operation of the pool cleaner provides sufficient weight to the hose when exiting the water for maintaining the inlet port on the submerged wall surface and thus preventing a sucking of air at the inlet port.

26. The pool cleaner according to claim 25, further comprising:

a primary wheel gear on each of the two opposing wheels;

a drive train operable with each of the primary wheel gears for driving the pool cleaner in the forward direction; and a secondary wheel gear on at least one of the two opposing wheels proximate and spaced from the primary wheel gear, wherein the drive train is operable for intermittent operation with the secondary gear for reversing rotation of the at least one of the two opposing wheels, and thus directing the pool cleaner away from the forward direction of movement.

27. The pool cleaner according to claim 25, wherein each of the two opposing wheels comprises treads extending about the perimeter thereof, and wherein at least one of the treads includes a protrusion extending beyond the perimeter for providing an enhanced traction to the treads, and thus pool cleaner.

28. The pool cleaner according to claim 25, further comprising a hose rotatably connected to the hose connector.

* * * * *